US010331069B2

(12) United States Patent
Hagiwara

(10) Patent No.: US 10,331,069 B2
(45) Date of Patent: Jun. 25, 2019

(54) IMAGE FORMING APPARATUS

(71) Applicant: CANON KABUSHIKI KAISHA, Tokyo (JP)

(72) Inventor: Hiroshi Hagiwara, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/042,238

(22) Filed: Jul. 23, 2018

(65) Prior Publication Data

US 2019/0033763 A1 Jan. 31, 2019

(30) Foreign Application Priority Data

Jul. 31, 2017 (JP) ..... 2017-147438

(51) Int. Cl.

*G03G 15/00* (2006.01)
*G03G 15/01* (2006.01)
*G03G 15/16* (2006.01)

(52) U.S. Cl.

CPC ..... *G03G 15/5058* (2013.01); *G03G 15/0121* (2013.01); *G03G 15/5041* (2013.01); *G03G 15/011* (2013.01); *G03G 15/0131* (2013.01); *G03G 15/1605* (2013.01); *G03G 2215/00599* (2013.01)

(58) Field of Classification Search

CPC ..... G03G 15/011; G03G 15/0121; G03G 15/0131; G03G 15/5041; G03G 15/5058; G03G 15/1605; G03G 2215/00599

See application file for complete search history.

(56) References Cited

U.S. PATENT DOCUMENTS

| | | | | |
|---|---|---|---|---|
| 8,218,989 | B2 * | 7/2012 | Fujita | G03G 15/0131 399/302 |
| 9,037,017 | B2 * | 5/2015 | Suzuki | G03G 15/5041 399/138 |
| 9,204,012 | B2 | 12/2015 | Furukawa | |
| 2008/0089702 | A1 * | 4/2008 | Takezawa | G03G 15/0194 399/32 |
| 2018/0017902 | A1 | 1/2018 | Hayami | |

FOREIGN PATENT DOCUMENTS

| | | | |
|---|---|---|---|
| JP | 2011-227459 | A | 11/2011 |
| JP | 2013-218148 | A | 10/2013 |
| JP | 2017-012679 | A | 1/2017 |
| JP | 2018-010102 | A | 1/2018 |

* cited by examiner

*Primary Examiner* — Hoang X Ngo
(74) *Attorney, Agent, or Firm* — Venable LLP

(57) ABSTRACT

The image forming apparatus includes an image adjustment unit that performs image adjustment on an image for adjustment formed on a rotary member by an image forming unit, based on a detection result by a detection unit. The image adjustment unit calculates the position of second data corresponding to the detection result by detecting an area in which the image for adjustment is formed, calculates first data corresponding to the position of the second data corresponding to the detection result by detecting an area in which the image for adjustment is not formed, and performs the image adjustment by using the first data and the second data.

15 Claims, 17 Drawing Sheets

IMAGE FORMING APPARATUS

BACKGROUND OF THE INVENTION

Field of the Invention

The present invention relates to an image forming apparatus, and particularly relates to an image forming apparatus using an electrophotographic system that performs image adjustment.

Description of the Related Art

Conventionally, it is common for an image forming apparatus to have a function for automatically controlling the image density in order to realize the correct color reproducibility and the color stability. In image density control, generally, a plurality of pictures for measurement (hereinafter referred to as the toner patches) are formed on a belt, which is a rotary member, while changing the imaging condition. Then, the toner patches are detected by a sensor provided in the image forming apparatus, the adhering amount of toner (hereinafter referred to as the toner adhering amount) is calculated based on a detection result, and the optimal imaging condition is determined based on the calculated result.

The detection principle in an optical sensor is to receive, by a light receiving element, reflected light from the toner patch or the belt itself with respect to light emitted from a light emitting element, and to calculate the toner adhering amount of the toner patch based on the result of the received light. The conversion to an actual toner adhering amount is performed based on the relationship between the output of the light receiving element with the toner patch and the output of the light receiving element without the toner patch at the substantially same position on the belt. The reason for considering not only the output of the light receiving element with the toner patch, but also the output of the light receiving element without the toner patch is that the reflected light from the toner patch is subject to not only the toner adhering amount but also the influence of the reflective index of a belt surface.

As a method of specifying the same position on the belt, there is a method of providing a mark serving as the standard on the belt and detecting this mark. However, since it is necessary to install a sensor (hereinafter referred to as the mark sensor) for detecting the mark, there are problems in that an apparatus becomes large and the cost is increased. Therefore, as disclosed in, for example, Japanese Patent Application Laid-Open No. 2013-218148, a method is proposed of specifying the substantially same position on the belt by matching waveform data of the belt, without providing the mark and the mark sensor.

However, in conventional methods, it is necessary to rotate the belt by a distance longer than one round of the belt at the time of performing the image adjustment. Thus, there is a problem in that it is impossible to reduce the time required for the density measurement less than the time for one round of the belt.

SUMMARY OF THE INVENTION

An aspect of the present invention is an image forming apparatus including a member configured to bear one of a toner image and a recording material and to rotate, an image forming unit configured to form the toner image on the rotary member, a detection unit configured to detect a reflection light amount by emitting a light to one of the rotary member and an image for adjustment formed on the rotary member, and receiving the light reflected from the one of the rotary member and the image for adjustment, an image adjustment unit configured to perform, based on a detection result, by the detection unit, image adjustment on the image for adjustment formed on the rotary member by the image forming unit, a first acquisition unit configured to acquire first data in association with a position on the rotary member in a state where the image for adjustment is not formed, the first data corresponding to a detection result, by the detection unit, of an area on the rotary member at which the image for adjustment is not formed, a second acquisition unit configured to acquire second data and third data in association with positions on the rotary member in a state where the image for adjustment is formed, the second data corresponding to a detection result, by the detection unit, of an area on the rotary member at which the image for adjustment is formed, and the third data corresponding to a detection result of an area on the rotary member at which the image for adjustment is not formed, and a comparison unit configured to compare the first data acquired by the first acquisition unit with the third data acquired by the second acquisition unit, wherein the image adjustment unit is configured to calculate the first data corresponding to the position of the second data on the rotary member, based on a comparison result obtained by the comparison unit, and performs the image adjustment by using the first data and the second data.

Further features of the present invention will become apparent from the following description of exemplary embodiments with reference to the attached drawings.

DESCRIPTION OF THE EMBODIMENTS

Figure 1A:
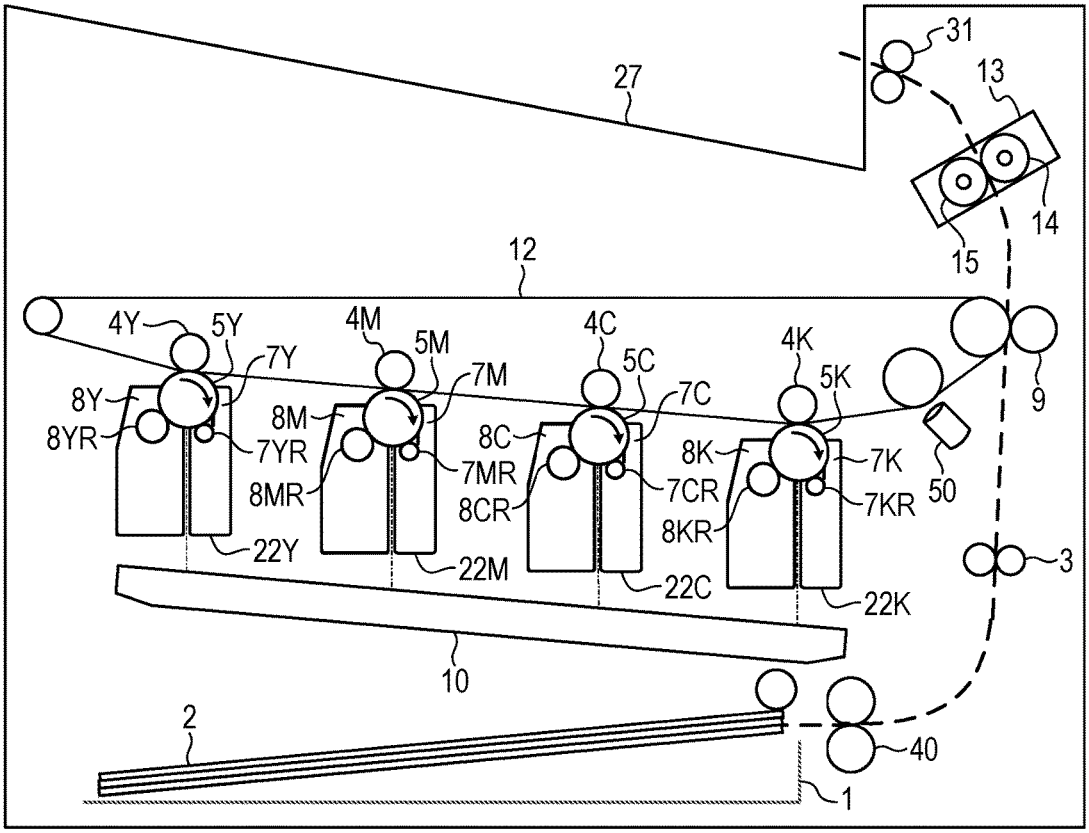
FIG. 1A and FIG. 1B are entire configuration diagrams of an image forming apparatus of Embodiments 1 to 3.

Preferred embodiments of the present invention will now be described in detail in accordance with the accompanying drawings.

Referring to the drawings, a preferred embodiment of this invention is described as an embodiment below in detail. However, the components described in this embodiment are merely illustrations, and it is not intended to limit the scope of this invention only to those components.

Embodiment 1

(Outline of Image Forming Apparatus)

Figure 1B:
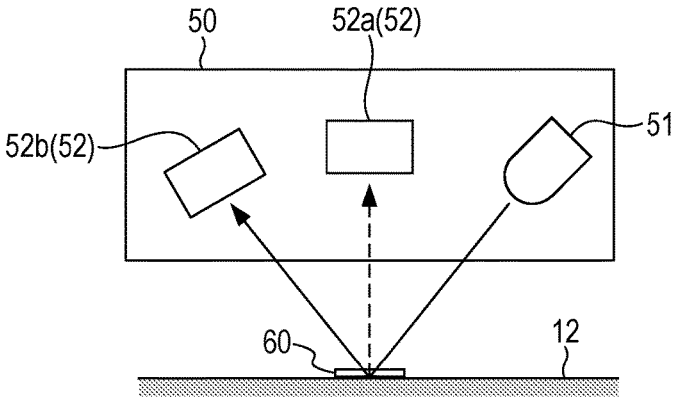

Referring to FIGS. 1A and 1B, an image forming apparatus of Embodiment 1 is described below. Referring to FIG. 1A, an explanation is given of the overview about the composition of an entire laser-printer engine (hereinafter, simply referred to as the printer) as a color image forming apparatus. A printer forms an electrostatic latent image by the light emitted based on a pixel signal transmitted from a controller unit (not shown), and develops the electrostatic latent image and performs superimposed transfer of a visible image to form a color visible image. The printer transfers the color visible image to a sheet of paper 2, and fixes the color visible image on the sheet of paper 2. An image forming unit includes photosensitive drums 5Y, 5M, 5C and 5K for respective juxtaposed stations for developing colors. Here, Y, M, C and K indicate yellow, magenta, cyan and black, respectively, and hereinafter, suffixes Y, M, C, and K are omitted except for the case where a specific color is described. Additionally, the image forming unit includes a charge device 7 as a charge unit, a developing unit 8, which is a developing device, a primary transfer roller 4, which is a primary transfer unit, and an intermediate transfer belt 12, which is a rotary member. The photosensitive drum 5, the charge device 7, and the developing unit 8 are mounted in a cartridge 22, which is an image forming unit removable from an image forming apparatus body. Further, the cartridge 22 should include at least the photosensitive drum 5, and it depends on the specification of a printer how many other members are to be included.

The photosensitive drum 5 is constituted by applying an organic photoconductive layer to the outer circumference of an aluminum cylinder, and is rotated by a driving force transmitted from a drive motor (not shown). The drive motor rotates the photosensitive drum 5 in the clockwise direction in the figure, according to an image formation operation. The exposing light to the photosensitive drum 5 is configured to be sent from a scanner unit 10, and to selectively expose the surface of the photosensitive drum 5, thereby forming an electrostatic latent image. The charge devices 7Y, 7M, 7C and 7K are provided with charge rollers 7YR, 7MR, 7CR and 7KR, respectively. The developing units 8Y, 8M, 8C and 8K are provided with developing rollers 8YR, 8MR, 8CR and 8KR, respectively.

At the time of color image formation, the intermediate transfer belt 12 rotates in the counterclockwise direction in the figure in a state where the intermediate transfer belt 12 contacts the photosensitive drum 5, and a visible image is transferred to the intermediate transfer belt 12 with a primary transfer voltage applied to the primary transfer roller 4. By sandwiching and conveying the sheet of paper 2 at a nip part of the intermediate transfer belt 12 and a secondary transfer roller 9, a color visible image is transferred to the sheet of paper 2 in an overlapping manner. The primary transfer roller 4 and the secondary transfer roller 9 rotate with rotation of the intermediate transfer belt 12. The sheet of paper 2 is stored in a paper feed tray 1, and is conveyed by a feed roller 40 and a registration roller pair 3 to the secondary transfer roller 9.

A fixing unit 13 fixes the transferred color visible image to the sheet of paper 2 while conveying the sheet of paper 2, and is provided with a fixing roller 14 for heating the sheet of paper 2 and a pressurizing roller 15 for pressing the sheet of paper 2 against the fixing roller 14. The fixing roller 14 and the pressurizing roller 15 are formed in hollow states, a heater is built inside of the fixing roller 14, and the heater is controlled so that the temperature of the heater turns into a temperature suitable for fixing. The sheet of paper 2 holding the color visible image is conveyed by the fixing roller 14 and the pressurizing roller 15, and a toner is fixed to the surface of the sheet of paper 2 by applying heat and pressure. The sheet of paper 2 to which the visible image is fixed is discharged to a discharge part 27 by a discharge roller 31, and an image formation operation ends.

A reflection light sensor 50 is arranged towards the intermediate transfer belt 12 in the image forming apparatus of FIG. 1A, and can detect the toner patch, which is the image for adjustment formed on the surface of the intermediate transfer belt 12. FIG. 1B is a diagram for describing the configuration of the reflection light sensor 50. The reflection light sensor 50 is configured by, for example, a light emitting element 51, which is a light emitting part such as an LED, a light receiving element 52 such as a photo diode, an IC (not shown), etc., for processing received light data, and a holder (not shown) for storing these components. The light emitting element 51 emits light to the intermediate transfer belt 12, and the light receiving element 52 detects a reflection light amount by receiving the light reflected from one of the intermediate transfer belt 12 and the toner patch 60 on the intermediate transfer belt 12 (on the rotary member). Additionally, a light receiving element 52*a* detects an irregular reflection light amount, and a light receiving element 52*b* detects a regular reflection light amount. By detecting both of the regular reflection light amount and the irregular reflection light amount, it is possible to detect the density of the toner patch from a high density to a low density.

(Functional Block Diagram)

Figure 2:
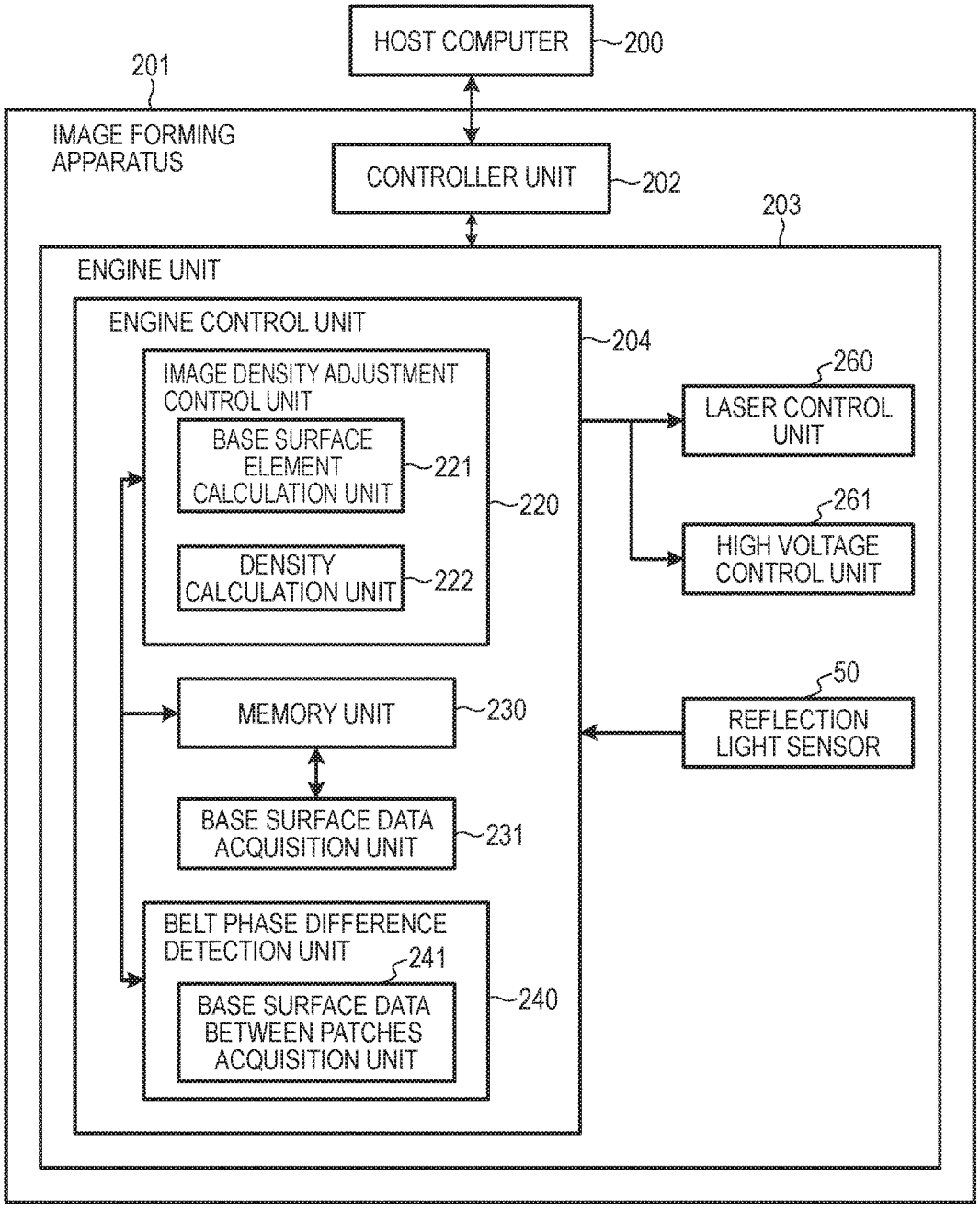
FIG. 2 is a functional block diagram of the image forming apparatus of Embodiment 1.

FIG. 2 is a functional block diagram of the image forming apparatus of Embodiment 1. An image forming apparatus 201 includes a controller unit 202 and an engine unit 203, and forms the toner patch of each color on the intermediate transfer belt 12 by one of a host computer 200 and the controller unit 202 to perform image adjustment control. The engine unit 203 includes an engine control unit 204 for controlling various operations of an engine, a laser control unit 260 for controlling a laser power, etc., a high voltage control unit 261 for controlling a high voltage for such as electrification and development, and the reflection light sensor 50. An image density adjustment control unit 220, which is an image adjustment unit, stores a detection result of the reflection light sensor 50 in a memory unit 230, and calculates, based on the detection result, the density of the toner patch from calculation results of a belt phase difference detection unit 240, a base surface element calculation unit 221, and a density calculation unit 222. The density of the toner patch calculated by the image density adjustment control unit 220 is fed back to the laser control unit 260 and the high voltage control unit 261, and is reflected to a process forming condition. The maximum density and the half tone gradation characteristic of each color are adjusted by the above control.

A base surface data acquisition unit 231, which is a first acquisition unit, stores the detection result of the reflection light sensor 50 in the memory unit 230. The belt phase difference detection unit 240 calculates the phase difference of the intermediate transfer belt 12 (hereinafter referred to as the belt phase difference) by using base surface data between patches acquired by a base surface data between patches acquisition unit 241, and using the detection result that the base surface data acquisition unit 231 stored in the memory unit 230. Further, the base surface data between patches refers to the data of the intermediate transfer belt 12 itself exposed between toner patches, that is, at a position in which a toner patch is not formed.

(Base Surface Data Acquisition Unit)

Figure 3A:
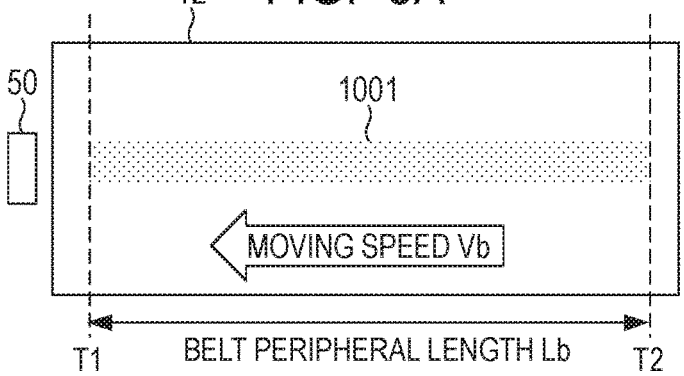
FIG. 3A, FIG. 3B and FIG. 3C are the diagrams for describing base surface data acquisition control of Embodiment 1.
Figure 3B:
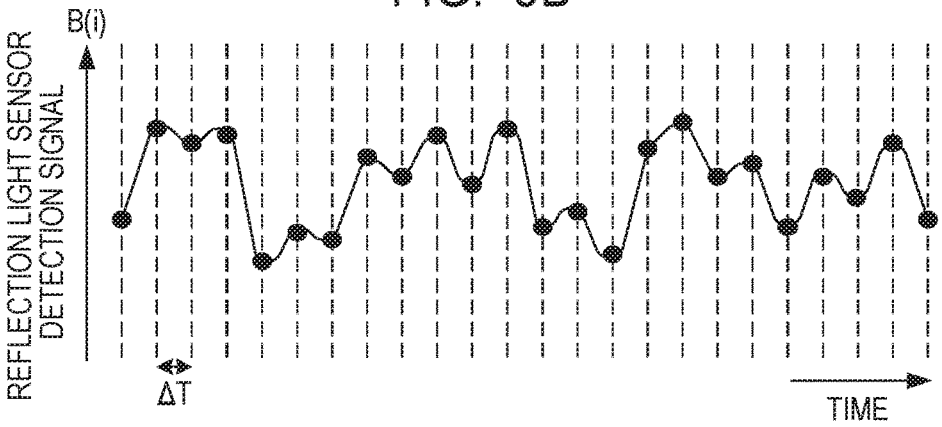
Figure 3C:
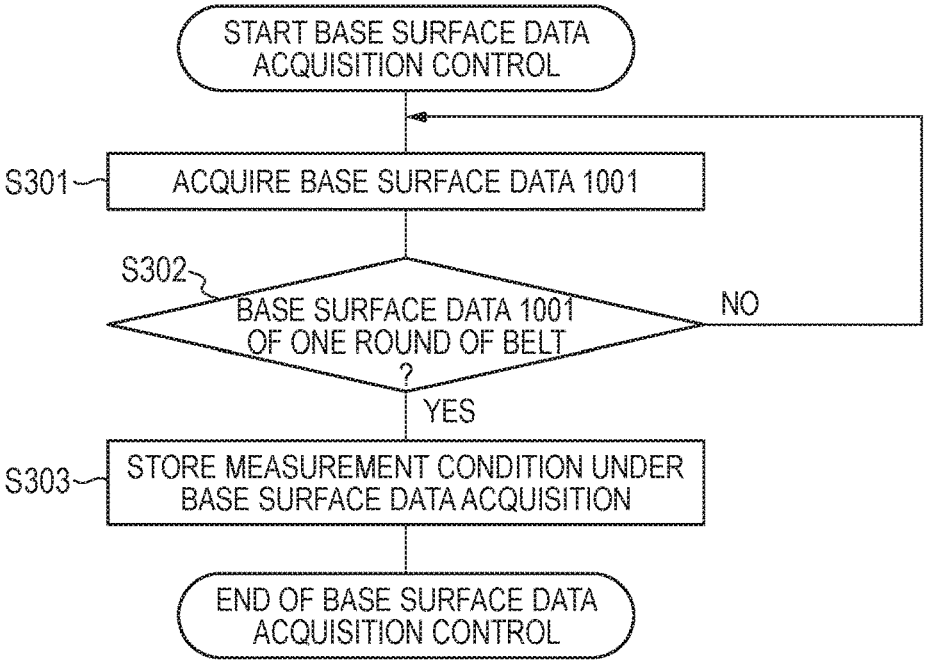

Referring to FIGS. 3A, 3B and 3C, base surface data acquisition control performed by the base surface data acquisition unit 231 is described. The base surface data acquisition unit 231 performs base surface data acquisition control in advance, before starting the image adjustment control (for example, image density adjustment control which will be described later). The base surface data acquisition control is performed at the timing at which the intermediate transfer belt 12 is newly mounted to the image forming apparatus 201, for example, at the timing of a mounting process of the intermediate transfer belt 12 to the image forming apparatus 201 in a factory. The base surface data acquisition unit 231 performs the base surface data acquisition control in a state where the intermediate transfer belt 12 is being conveyed at a moving speed Vb. Base surface data 1001 is acquired by the reflection light sensor 50 during the period from a timing T1 to a timing T2. The base surface data 1001 is data of an area in which a toner patch is not formed. The timing T1 is a timing at which the base surface data acquisition control was started, and is used as a basis. Here, the timing T2 is the timing at which the intermediate transfer belt 12 rotates for a length (hereinafter referred to as the belt peripheral length) Lb in the moving direction of the intermediate transfer belt 12 for at least one round.

FIG. 3A illustrates the intermediate transfer belt 12, the base surface data 1001, and an acquisition timing (from the timing T1 to the timing T2) of the base surface data 1001. The base surface data acquisition unit 231 acquires a detection signal detected by, at a sampling interval ΔT (a predetermined time interval), the light receiving element 52*b* of the reflection light sensor 50, and stores the detection signal in the memory unit 230 as the base surface data 1001, which is first data. FIG. 3B illustrates an example of the acquired base surface data 1001. The data shown by black dots in FIG. 3B is the acquired base surface data 1001, and is the detection signal detected by the reflection light sensor 50. A horizontal axis in FIG. 3B represents the time, and the time interval between data is the sampling interval ΔT.

Each base surface data 1001 is denoted by B(i), where i is called a phase. The phase i indicates the position on the intermediate transfer belt 12 when the time progresses for the sampling interval ΔT×i from the timing T1, serving as the basis. For example, B (i=0) indicates the base surface data 1001 at the timing T1. In Embodiment 1, it is assumed that the moving speed Vb of the intermediate transfer belt 12=200 [mm/sec (millimeter per second)], the peripheral length Lb of the intermediate transfer belt 12=950 [mm (millimeter)], and the sampling interval ΔT=0.005 [sec (second)].

Next, referring to the flow chart of FIG. 3C, the base surface data acquisition control is described. The processing shown in this flow chart is processing performed by the base surface data acquisition unit 231, which is shown in FIG. 2, according to a control program. The intermediate transfer belt 12 is driven at the moving speed Vb in advance by the engine control unit 204.

In step (hereafter referred to as S) 301, the base surface data acquisition unit 231 acquires the base surface data 1001 of the intermediate transfer belt 12 at the sampling intervals ΔT, and stores the base surface data 1001 in the memory unit 230. In S302, the base surface data acquisition unit 231 determines whether or not the base surface data 1001 is acquired for one rotation of the intermediate transfer belt 12 (hereinafter referred to as the one round of the belt). In S302, when the base surface data acquisition unit 231 determines that the base surface data 1001 for one round of the belt is not acquired, the base surface data acquisition unit 231 returns the processing to S301, and continues the acquisition of the base surface data 1001. In S302, when the base surface data acquisition unit 231 determines that the base surface data 1001 for one round of the belt is acquired, the processing proceeds to S303. Here, when the base surface data acquisition unit 231 determines that the number of samples of the acquired base surface data 1001 becomes equal to or more than the number of samples corresponding to one round of the belt, the base surface data acquisition unit 231 determines that the base surface data 1001 for one round of the belt is acquired. Further, the number of samples corresponding to one round of the belt is calculated from Lb/Vb/ΔT. As described above, the base surface data acquisition unit 231 acquires the base surface data 1001 in association with the phase (position) of the intermediate transfer belt 12. The base surface data 1001 is the first data according to the result of detecting the surface of the intermediate transfer belt 12 by the reflection light sensor 50.

In S303, the base surface data acquisition unit 231 stores, in the memory unit 230, a measurement condition when the base surface data 1001 is acquired. Here, the information of the emitted light amount of the reflection light sensor 50 is stored in the memory unit 230 as a measurement condition C1, which is a first measurement condition. Further, the measurement condition C1 stored in S303 may store information that may affect the base surface data 1001 due to change in the condition, in addition to the emitted light amount of the reflection light sensor 50. For example, as the measurement condition C1, there are the remaining life of the intermediate transfer belt 12 and the ambient temperature of the intermediate transfer belt 12.

(Image Density Adjustment Control Unit)

Figure 4:
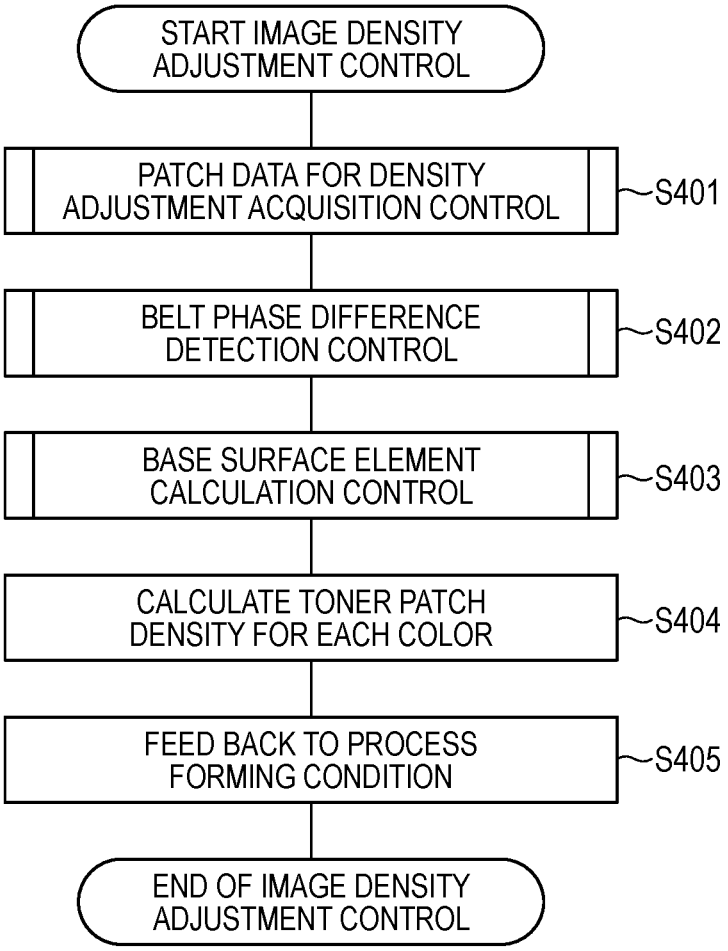
FIG. 4 is a flow chart illustrating the image density adjustment control of Embodiment 1.

Next, referring to the flow chart of FIG. 4, the flow of the image density adjustment control performed by the image density adjustment control unit 220 of Embodiment 1 is described. First, in S401, the image density adjustment control unit 220 acquires a toner patch for density adjustment by patch data acquisition control for density adjustment which will be described later, and acquires the reflection light amount of the base surface of the intermediate transfer belt 12 between toner patches (hereinafter referred to as the base surface between patches). The image density adjustment control unit 220 stores each of the acquired data in the memory unit 230 as measurement data.

In S402, the image density adjustment control unit 220 calculates a belt phase difference Δp of the intermediate transfer belt 12 by a belt phase difference detection control which will be described later. In S403, the image density adjustment control unit 220 calculates, by base surface element calculation control which will be described later, the base surface data each corresponding to the measurement data measured in S401. In S404, the image density adjustment control unit 220 calculates the density of the toner patch of each color from the base surface data calculated in S403 and from the patch data for density adjustment stored in the memory unit 230 in S401. In S405, the image density adjustment control unit 220 feeds back, to a process forming condition, the density of the toner patch of each color calculated in S404.

(Patch Data Acquisition Control for Density Adjustment)

Figure 5A:
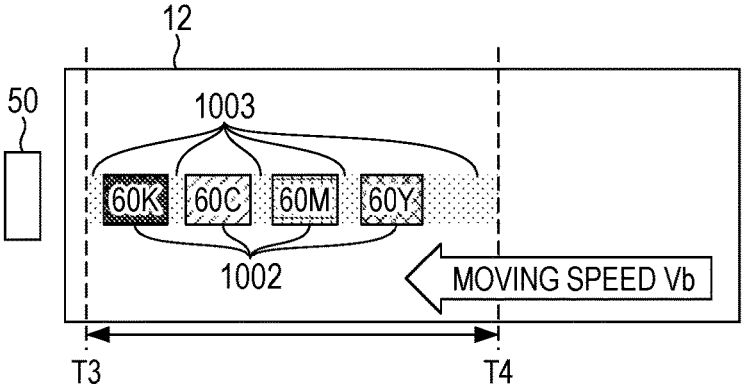
FIG. 5A, FIG. 5B and FIG. 5C are diagrams for describing the patch data acquisition control for the density adjustment of Embodiments 1 and 3.
Figure 5B:
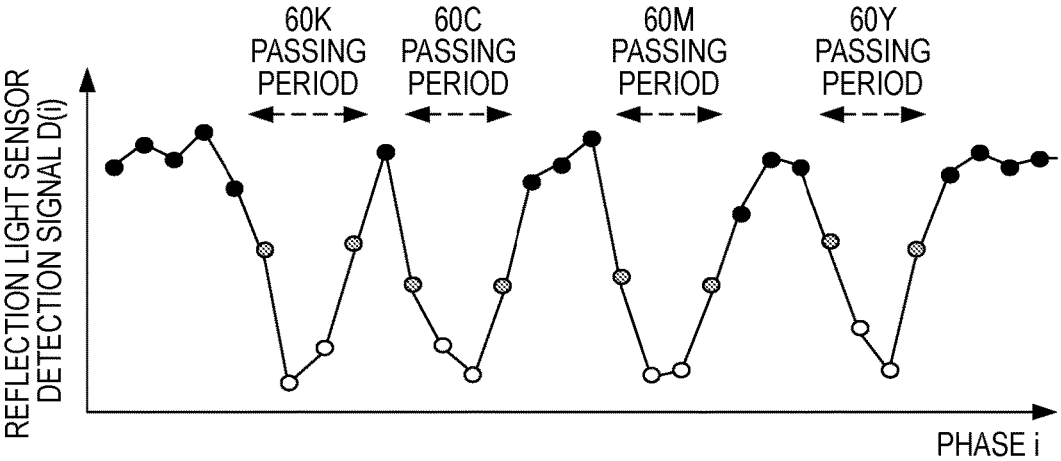
Figure 5C:
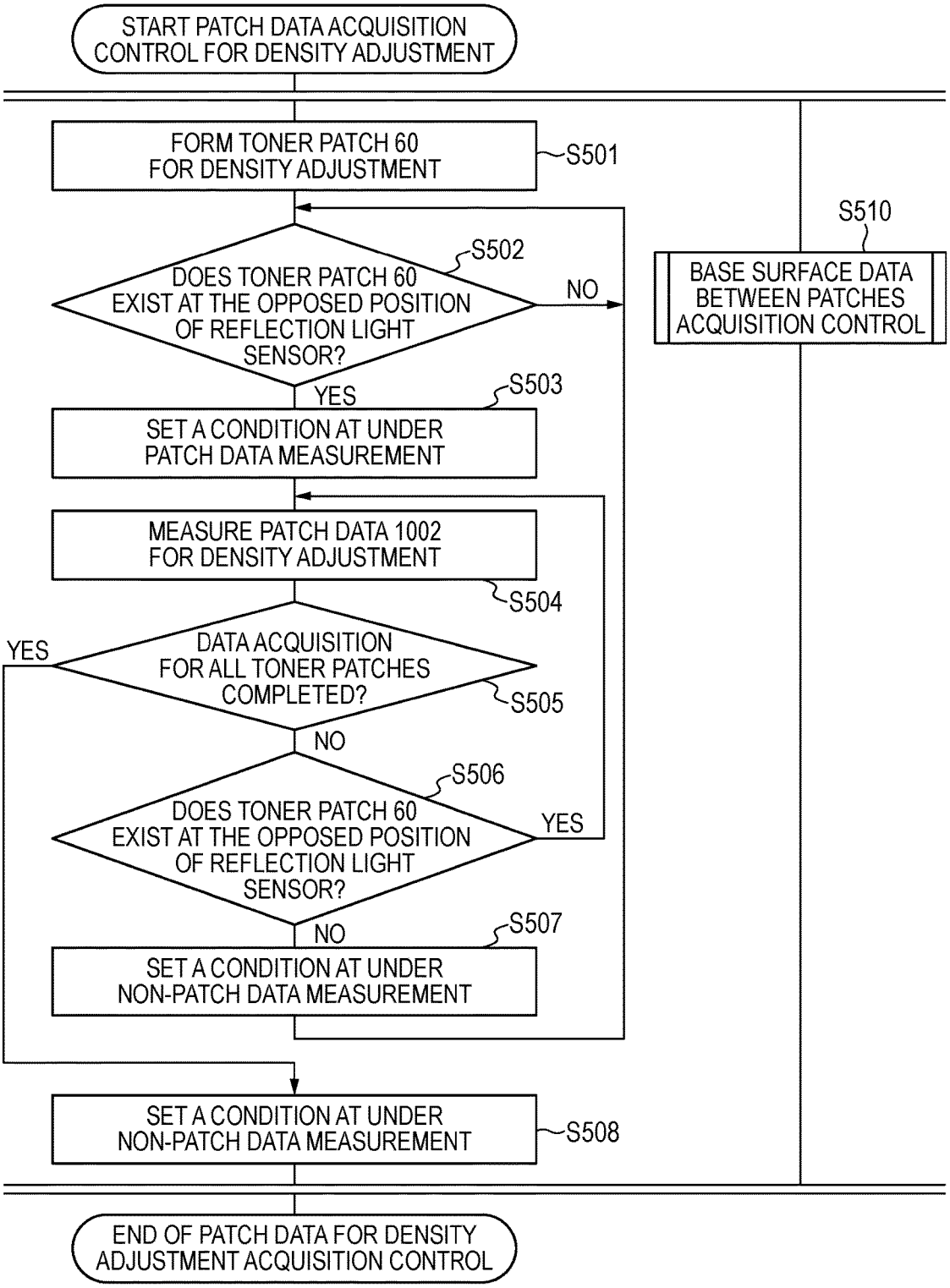

Referring to FIGS. 5A, 5B and 5C, the patch data acquisition control for density adjustment performed by the image density adjustment control unit 220 in S401 of FIG. 4 is described. FIG. 5A is a diagram illustrating an example of the toner patch for density adjustment formed on the intermediate transfer belt 12. A toner patch 60 consists of toner patches 60K, 60C, 60M and 60Y that are output from respective stations, and each toner patch is formed by providing a predetermined interval between toner patches such that the toner patches do not overlap on each other. Further, the number and kind of the toner patch 60 are not limited to those illustrated in this Embodiment, and may change according to the belt peripheral length Lb of the intermediate transfer belt 12, the time required for the density control, the accuracy required, and the like.

The detection signal detected by the reflection light sensor 50 is acquired at the sampling intervals ΔT described above in a range between timings T3 and T4, and is stored in the memory unit 230. Here, the data stored in the memory unit 230 includes patch data 1002 for density adjustment, which is second data, and base surface data between patches 1003, which is third data. The reflection light sensor 50 acquires the base surface data between patches 1003, which is the data of an area in which the toner patch 60 is not formed, and acquires the patch data 1002, which is the data of an area in which the toner patch 60 is formed. The image density adjustment control unit 220, which acquires the second data, and the base surface data between patches acquisition unit 241, which acquires the third data, function as a second acquisition unit. Further, the timing T3 is an arbitrary timing before the toner patch 60 formed on the intermediate transfer belt 12 reaches the reflection light sensor 50. A timing T4 is a timing at which the acquisition of all of the toner patches 60 is completed, and the measurement of the base surface data between patches 1003 for a predetermined number or more is completed.

FIG. 5B illustrates the measurement data (the patch data 1002 for density adjustment and the base surface data between patches 1003) stored in the memory unit 230 by the patch data acquisition control for density adjustment. The vertical axis in FIG. 5B represents the detection signal D(i) of the reflection light sensor 50, and the horizontal axis represents the phase i. Each measurement data is denoted as D(i). Here, the phase i indicates the position on the intermediate transfer belt 12 when the time of the sampling interval ΔT×phase i progresses based on the timing T3. For example, D (i=0) indicates the measurement data of the position on the intermediate transfer belt 12 at the timing T3. Additionally, the kinds of the measurement data are distinguished by the processing in the flow chart which will be described later. The white dots in FIG. 5B represent the patch data 1002 for density adjustment, the black dots represent the base surface data between patches 1003, and the gray dots represent the data that is removed from the base surface data between patches 1003. Further, in FIG. 5B, broken line arrows represent passage sections of the toner patch 60 (a 60K passage section, etc.). As illustrated in FIG. 5B, the sections of the white dot sandwiched between the gray dots are the passage sections of the toner patches 60K, 60C, 60M and 60Y of respective colors.

Referring to the flow chart of FIG. 5C, the flow of the patch data acquisition control for density adjustment of Embodiment 1 is described. In S501, the image density adjustment control unit 220 forms, on the intermediate transfer belt 12 moving at the moving speed Vb, the toner patch 60 for density adjustment determined in advance. In S502, the image density adjustment control unit 220 determines whether or not the toner patch 60 exists at the opposed position of the reflection light sensor 50. When it is determined that the toner patch 60 does not exist at the opposed position of the reflection light sensor 50, the image density adjustment control unit 220 returns the processing to S502, and waits for the toner patch 60 to arrive. In the determination in S502, the image density adjustment control unit 220 determines whether or not the toner patch 60 reached the reflection light sensor 50 based on, for example, the following information. That is, it is determined whether or not the toner patch 60 reached the reflection light sensor 50 by the timing information delayed for the time until the toner patch 60 reached the reflection light sensor 50 since the timing information at which the toner patch 60 was formed in S501. In S502, when the image density adjustment control unit 220 determines that the toner patch 60 exists at the opposed position of the reflection light sensor 50, the processing proceeds to S503. In S503, the image density adjustment control unit 220 sets the condition of the patch data acquisition control for density adjustment under patch data measurement. The information indicating patch data measurement is information for acquiring data while synchronizing with the base surface data between patches acquisition control which will be described later.

In S504, the image density adjustment control unit 220 acquires the patch data 1002 for density adjustment at the sampling intervals ΔT, and stores the patch data 1002 for density adjustment in the memory unit 230. Further, the patch data 1002 for density adjustment is stored as the measurement data D(i) associated with the phase i. Here, the phase i is the value calculated by dividing the elapsed time from the timing T3 at which the control was started by the sampling interval ΔT.

In S505, the image density adjustment control unit 220 determines whether or not the data acquisition for all toner patches 60 for density adjustment formed in S501 was completed. In S505, when the image density adjustment control unit 220 determines that an unmeasured toner patch exists, the processing proceeds to S506. In S506, the image density adjustment control unit 220 determines whether or not the toner patch 60 exists at the opposed position of the reflection light sensor 50. Further, it is assumed that the determination method in S506 uses the same method as the aforementioned determination method in S502. In S506, when the image density adjustment control unit 220 determines that the toner patch 60 exists at the opposed position of the reflection light sensor 50, when the image density adjustment control unit 220 returns the processing to S504, and continues the data acquisition of the toner patch 60. In S506, when the image density adjustment control unit 220 determines that the toner patch 60 does not exist at the opposed position of the reflection light sensor 50, the processing proceeds to S507. In S507, the image density adjustment control unit 220 changes the information of a condition under patch data measurement set in S503 to a condition under non-patch data measurement, and returns the processing to S502.

In S505, when the image density adjustment control unit 220 determines that the data acquisition for all toner patches 60 for density adjustment is completed, the processing proceeds to S508. In S508, the image density adjustment control unit 220 changes the information of the condition under patch data measurement set in S503 to the condition under non-patch data measurement. Additionally, in S510, the base surface data between patches acquisition unit 241 performs the base surface data between patches acquisition control which will be described later in parallel to the processing in S501 to S508.

The image density adjustment control unit 220 waits until the acquisition of both of the patch data 1002 for density adjustment and the base surface data between patches 1003 is completed, and ends the patch data acquisition control for density adjustment. In this manner, it is possible to acquire a predetermined number of the base surface data between patches 1003, even when the shape (the number, size, or interval between patches) of the toner patch 60 for image adjustment is changed, and a patch interval is decreased. Accordingly, it is possible to secure the accuracy of the belt phase difference detection control which will be described later.

(Base Surface Data Between Patches Acquisition Unit)

Figure 6:
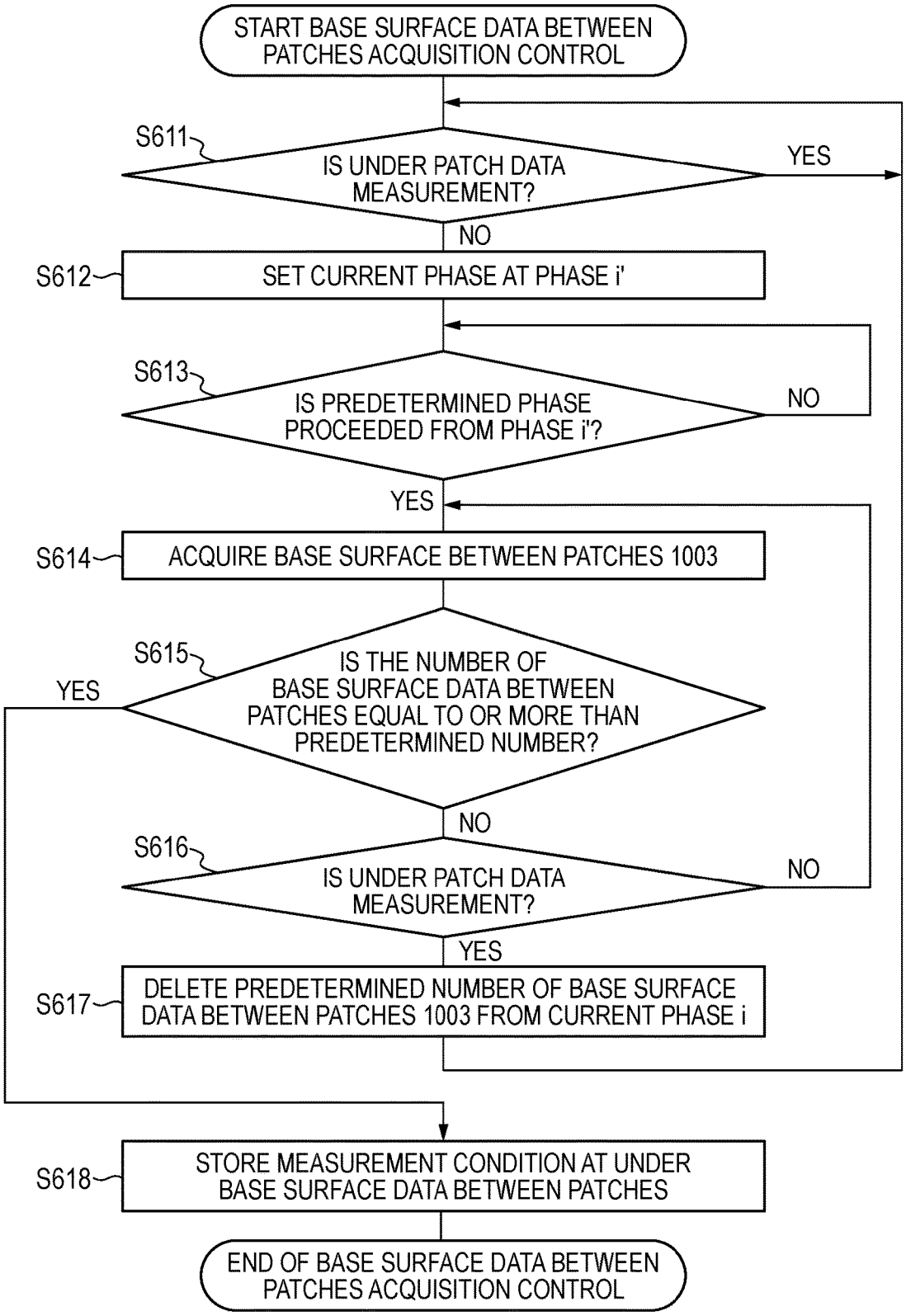
FIG. 6 is a flow chart illustrating the base surface data between patches acquisition control of Embodiment 1.

Next, referring to the flow chart of FIG. 6, the flow of the base surface data between patches acquisition control performed by the base surface data between patches acquisition unit 241 is described. The base surface data between patches acquisition control is performed by the processing in S510 of the aforementioned patch data acquisition control for density adjustment. In S611, the base surface data between patches acquisition unit 241 determines whether or not the condition of control is under patch data measuring. In S611, when the base surface data between patches acquisition unit 241 determines that the condition is under patch data measurement, the base surface data between patches acquisition unit 241 returns the processing to S611, and waits until the patch data acquisition control for density adjustment reaches the timing at which the patch data acquisition is not performed. In this manner, it is prevented that the patch data 1002 for density adjustment and the base surface data between patches 1003 are acquired at the same timing. In S611, when the base surface data between patches acquisition unit 241 determines that the condition is not under patch data measurement, the processing proceeds to S612. In S612, the base surface data between patches acquisition unit 241 sets the current phase i at phase i', and stores the phase i' in the memory unit 230. Here, the phase i is the same as the value used for the measurement data D(i) in S504 described above.

In S613, the base surface data between patches acquisition unit 241 determines whether or not a predetermined phase has proceeded from the phase i' stored in S612. When the base surface data between patches acquisition unit 241 determines that the predetermined phase has not proceeded, the base surface data between patches acquisition unit 241 returns the processing to S613. The base surface data between patches acquisition unit 241 waits for the phase i to proceed the minimum distance between patches Δi_min or more, for example. Here, the minimum distance between patches Δi_min is a distance secured so that the base surface data between patches 1003 is not influenced by the toner patch 60. For example, the minimum distance between patches Δi_min can be calculated from the spot diameter of a light receiving unit of the reflection light sensor 50, etc. In S613, when the base surface data between patches acquisition unit 241 determines that the phase i proceeds the minimum distance between patches Δi_min or more, the processing proceeds to S614.

In S614, the base surface data between patches acquisition unit 241 acquires the base surface data between patches 1003 at the sampling intervals ΔT, and stores the base surface data between patches 1003 in the memory unit 230. Further, similar to the patch data 1002 for density adjustment, the base surface data between patches 1003 is associated with the phase i and is stored in the measurement data D(i). In S615, the base surface data between patches acquisition unit 241 determines whether or not the number of the base surface data between patches 1003 is equal to or more than a predetermined number N. In S615, when the base surface data between patches acquisition unit 241 determines that the number of the base surface data between patches 1003 is not equal to or more than the predetermined number N, the processing proceeds to S616.

In S616, the base surface data between patches acquisition unit 241 determines whether or not the condition of control is under patch data measurement. In S616, when the base surface data between patches acquisition unit 241 determines that it is not under patch data measurement, the base surface data between patches acquisition unit 241 returns the processing to S614, and continues the acquisition of the base surface data between patches 1003. In S616, when the base surface data between patches acquisition unit 241 determines that the condition of control is under patch data measuring, the processing proceeds to S617.

In S617, the base surface data between patches acquisition unit 241 deletes the base surface data between patches 1003 stored in the memory unit 230, specifically, a predetermined number of base surface data between patches 1003 from the current phase i among D(i) on, and returns the processing to S611. The predetermined number is the minimum distance between patches Δi_min. Specifically, the base surface data between patches acquisition unit 241 deletes the base surface data between patches 1003 in the range from the current phase i to "(the current phase i)−(the minimum distance between patches Δi_min)". In this manner, the data that may be under influence of the toner patch 60 is removed from the base surface data between patches 1003. The removed data corresponds to the data of the gray dots in FIG. 5B. In the processing of S613 and S617, the base surface data between patches 1003 that is within a predetermined range from one of the tip and the rear end of the toner patch 60 for density adjustment in the rotation direction of the intermediate transfer belt 12 is eliminated from the data for detecting a phase difference p which will be described later.

In S615, when the base surface data between patches acquisition unit 241 determines that the number of the base surface data between patches 1003 is equal to or more than the predetermined number N, the base surface data between patches acquisition unit 241 returns the processing to S618. In S618, the base surface data between patches acquisition unit 241 stores, in the memory unit 230, a measurement condition C2, which is a second measurement condition at the time of acquiring the base surface data between patches, and ends the base surface data between patches acquisition control. Here, it is assumed that the measurement condition C2 stored in the memory unit 230 is the same kind of information as the measurement condition C1 stored in S303 of FIG. 3C. Additionally, in Embodiment 1, it is assumed that the minimum distance between patches Δi_min=1, and the predetermined number N of the base surface data between patches 1003 is, for example, 100, etc.

Further, for example, when the engine control unit 204 includes a large-capacity memory unit 230, the data acquisition may be performed as follows. When performing detection by the reflection light sensor 50, all data is acquired first and is stored in the memory unit 230, without determining whether the data is the patch data 1002 or the base surface data between patches 1003. Then, regarding the data stored in the memory unit 230, the determination may be made whether the acquired data is the patch data 1002 or the base surface data between patches 1003.

(Belt Phase Difference Detection Unit)

Figure 7A:
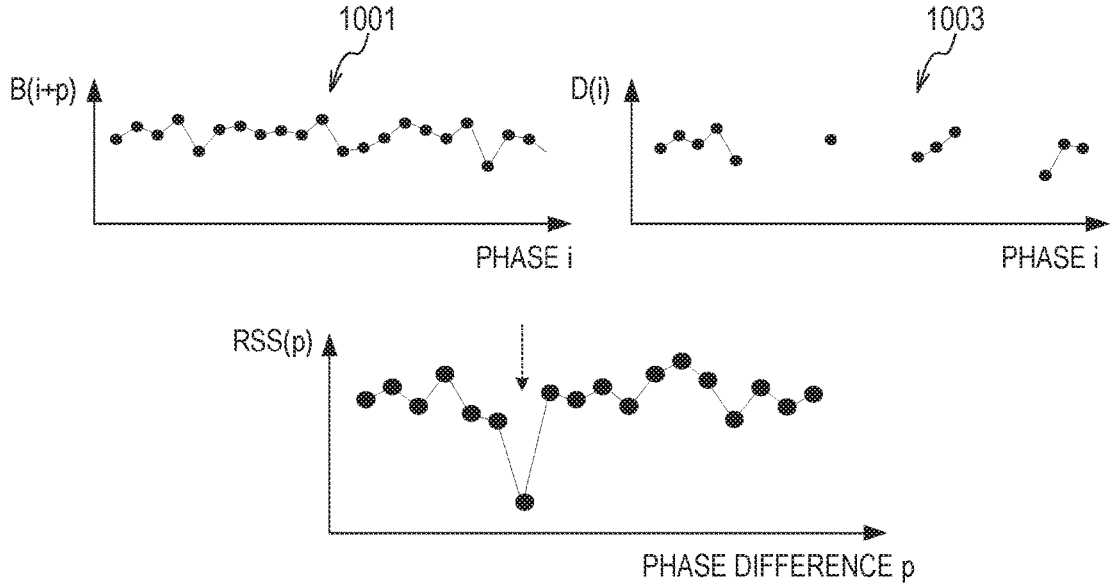
FIG. 7A and FIG. 7B are diagrams for describing the belt phase difference detection control of Embodiment 1.
Figure 7B:
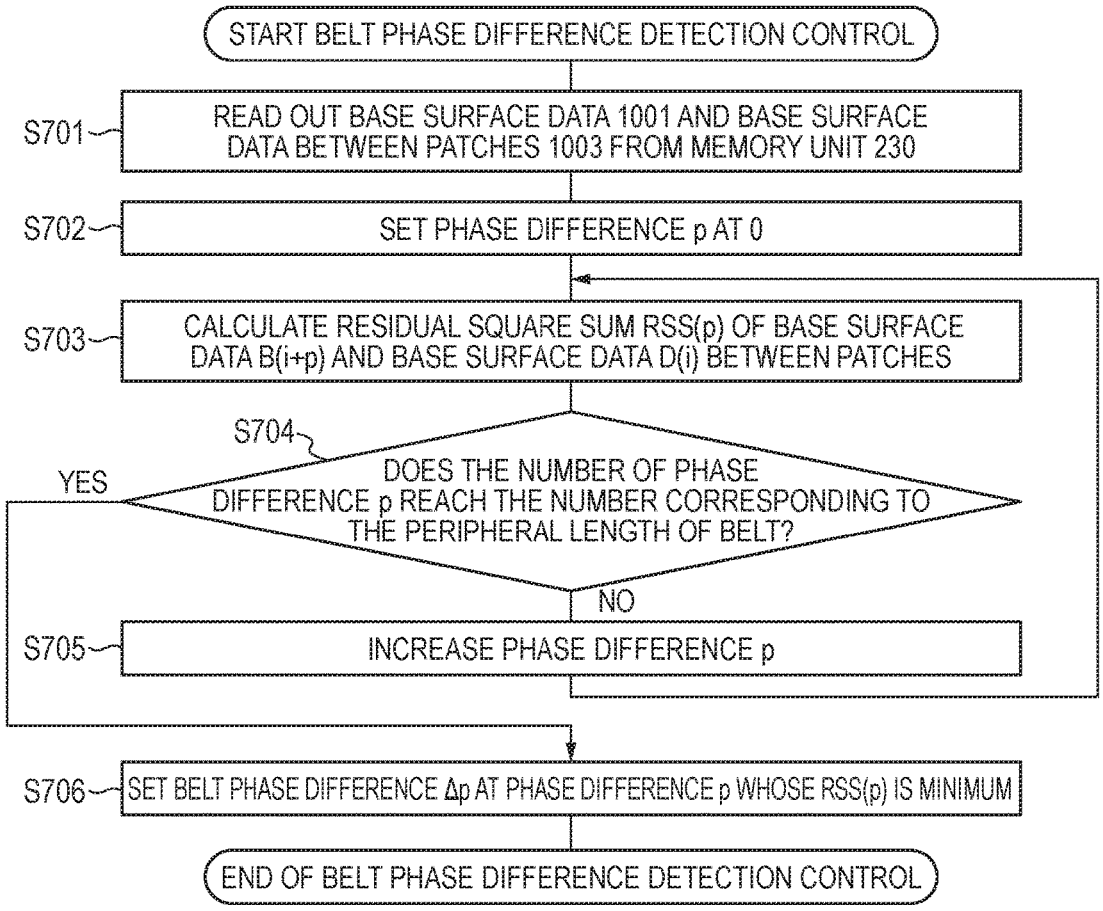

Referring to FIGS. 7A and 7B, the belt phase difference detection control performed in S402 of FIG. 4 by the belt phase difference detection unit 240, which is a difference detection unit, is described. In the belt phase difference detection control, matching is performed between the base surface data 1001 described with reference to FIGS. 3A, 3B and 3C and the base surface data between patches 1003 described with reference to FIG. 6, and the optimum phase is obtained in which the base surface data substantially match. That is, the difference detection unit can also be called a comparison unit for comparing the base surface data 1001 and the base surface data between patches 1003. In Embodiment 1, the residual square sum RSS (=Residual sum of squares) is used as the method of matching. Residual square sum RSS (p) is calculated from Formula (1).

$$\mathrm{RSS}\ (p)=\Sigma(\mathrm{Dtype}(i)\times(D(i)-B\ (i+p))^2) \quad (1)$$

Here, Σ represents the total of the range from the phase i=0 to the phase number equivalent to the phase i=belt peripheral length Lb (=Lb/Vb/ΔT). A base surface data determination function Dtype(i) is a function that returns 1, when the measurement data D(i) is the base surface data between patches 1003, and returns 0 otherwise (when the measurement data D(i) is the patch data 1002 or data disregarded at the time of measurement).

Additionally, the base surface data B(i) is treated as data repeated with the cycle of the belt peripheral length Lb. Specifically, when the phase i equal to or more than the number of the base surface data 1001 stored in the memory unit 230 is specified, base surface data B (i') is acquired by changing the phase i to the remainder value (i') calculated by dividing the phase i by the phase number corresponding to the belt peripheral length Lb (=Lb/Vb/ΔT). In the belt phase difference detection control, the residual square sum RSS (p) is calculated by shifting one phase of the phase difference p at a time, and the phase difference p when the residual square sum RSS (p) becomes the smallest is set to the belt phase difference Δp between the base surface data 1001 and the base surface data between patches 1003.

FIG. 7A illustrates the outline of the base surface data 1001 stored in the memory unit 230, the base surface data between patches 1003, and the residual square sum RSS (p) calculated by using the base surface data 1001 and the base surface data between patches 1003. As for the graphs of the base surface data 1001 (B (i+p)) and the base surface data between patches 1003 (D(i)), the horizontal axis represents the phase i. As for the graph of the residual square sum RSS (p), the horizontal axis represents the phase difference p. As illustrated in the graph of the residual square sum RSS (p) of FIG. 7A, the value becomes small only at the phase difference p between the base surface data B (i+p) and the base surface data between patches D(i) when the phases in the intermediate transfer belt 12 are aligned. Accordingly, the belt phase difference Δp can be calculated from the residual square sum RSS (p).

Next, referring to the flow chart of FIG. 7B, the flow of the belt phase difference detection control performed by the belt phase difference detection unit 240 is described. In S701, the belt phase difference detection unit 240 reads out, from the memory unit 230, the base surface data 1001 acquired by the base surface data acquisition control in advance and the base surface data between patches 1003 acquired by the base surface data between patches acquisition control. In S702, the belt phase difference detection unit 240 sets the phase difference p between the base surface data 1001 and the base surface data between patches 1003 at 0 at the present moment.

In S703, the belt phase difference detection unit 240 calculates the residual square sum RSS (p) of the base surface data B (i+p) and the base surface data between patches D(i) using the Formula (1). In S704, the belt phase difference detection unit 240 determines whether or not the number of the phase difference p is equal to or more than the phase number corresponding to the belt peripheral length Lb of the intermediate transfer belt 12 (=Lb/Vb/ΔT). In S704, when the belt phase difference detection unit 240 determines that the number of the phase difference p does not reach the phase number corresponding to the belt peripheral length Lb, the belt phase difference detection unit 240 advances the processing to S705. In S705, the belt phase difference detection unit 240 increases the phase difference p, and returns the processing to S703. In S703, the belt phase difference detection unit 240 calculates the residual square sum RSS (p) in a state where the phase of the base surface data B (i+p) is shifted by one with respect to the base surface data between patches D(i).

In S704, when the belt phase difference detection unit 240 determines that the number of the phase difference p is equal to or more than the phase number corresponding to the belt peripheral length Lb, the processing proceeds to S706. In S706, the belt phase difference detection unit 240 sets, at the belt phase difference Δp, the phase difference p whose value of RSS (p) is minimum among the values of RSS (p) acquired thus far, and ends the control. Further, the phase difference p at the time when the value of RSS (p) becomes equal to or less than a constant value may be set at the belt phase difference Δp, without calculating the residual square sum RSS (p) for all phase differences p. In this case, the calculation of the residual square sum RSS (p) may be omitted for the phase difference p after determining the belt phase difference Δp.

As described above, the belt phase difference detection unit 240 detects the phase difference p (difference) for aligning the phase (position) of the base surface data 1001 and the phase (position) of the base surface data between patches 1003, based on the base surface data 1001 and the base surface data between patches 1003. The belt phase difference detection unit 240 calculates the residual square sum of the base surface data B(i) and the base surface data between patches D(i), by shifting the phase of base surface data B(i) over at least one round of the intermediate transfer belt 12. Then, the belt phase difference detection unit 240 sets, at the belt phase difference Δp, the quantity (p) by which the phase is shifted when the residual square sum RSS (p) becomes the smallest.

(Base Surface Element Calculation Unit)

Next, the base surface element calculation control performed by the base surface element calculation unit 221 in S403 of FIG. 4 is described. The base surface element in Embodiment 1 is the reflection light amount from the intermediate transfer belt 12 detected by the reflection light sensor 50 in each position (each phase) of the intermediate transfer belt 12. The base surface element calculation unit 221 calculates the patch base surface data Bd(i) with the phase i which is substantially the same as the phase i at which the patch data D(i) for density adjustment is measured, using the belt phase difference Δp calculated by the belt phase difference detection control in S402 of FIG. 4 (FIG. 7B). The patch base surface data Bd(i) is calculated by using Formula (2).

$$Bd(i)=B(i+\Delta p)\times C \quad (2)$$

Here, the base surface data B (i+Δp) is treated as data repeated with the cycle of the belt peripheral length Lb, by using the same method as in the Formula (1). Additionally, a correction coefficient C is a coefficient calculated from the measurement condition C1 at the time of the base surface data measurement stored in S303 of FIG. 3C, and from the measurement condition C2 at the time of the base surface data between patches measurement stored in S618 of FIG. 6. In Embodiment 1, it is assumed that the measurement conditions C1 and C2 are the emitted light amounts of the reflection light sensor 50, and the correction coefficient C is calculated by using Formula (3).

$$C=L(C2)/L(C1) \quad (3)$$

Figure 8:
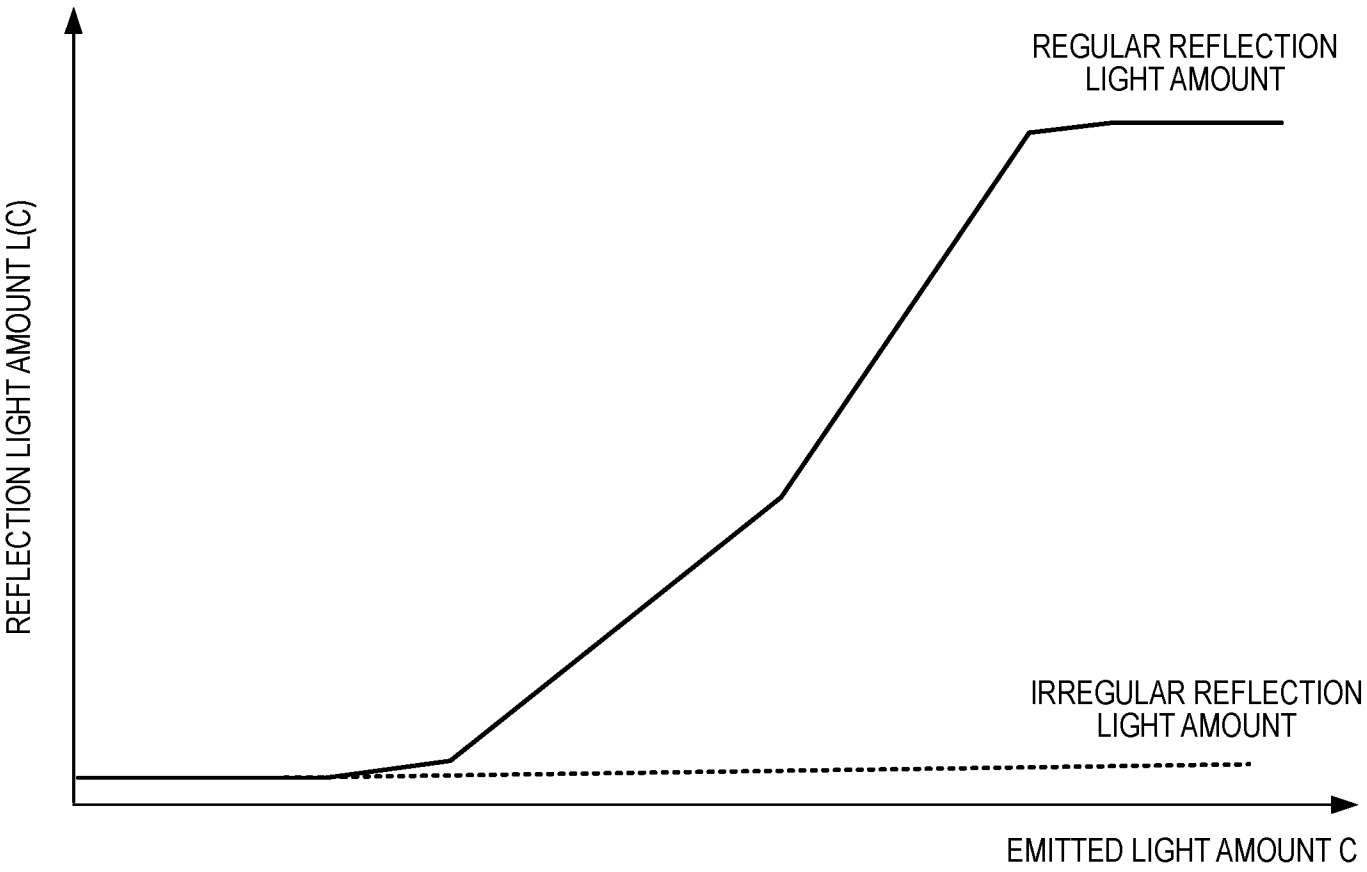
FIG. 8 is a diagram illustrating the relationship between the emitted light amount of a reflection light sensor and the reflection light amount of the reflected light sensor of Embodiment 1.

Here, it is assumed that a reflection light amount L(C) is a function for calculating the reflection light amount from the intermediate transfer belt 12 in the emitted light amount C, and is a predetermined function. FIG. 8 illustrates an example of the characteristics of the reflection light amount L(C) in Embodiment 1. In FIG. 8, the vertical axis represents the reflection light amount L(C), and the horizontal axis represents the emitted light amount C. Additionally, a continuous line indicates the regular reflection light amount, and a dotted line indicates the irregular reflection light amount. In this manner, the gap in the base surface data that occurs due to the difference between the measurement conditions at the time of base surface data measurement and at the time of the patch measurement is corrected.

As described above, the image density adjustment control unit 220 calculates the base surface data 1001 having a phase that is substantially the same as the phase of the patch data 1002 for density adjustment on the intermediate transfer belt 12, based on the phase difference p. The image density adjustment control unit 220 performs image adjustment by using the calculated base surface data 1001 and the patch data 1002 for density adjustment.

As described above, according to Embodiment 1, it is possible to obtain the phase difference of the intermediate transfer belt 12 between the phase at the time of the base surface data measurement and the phase at the time of the density adjustment patch measurement, by performing matching between the base surface data acquired in advance and the base surface data between patches acquired between patches. Therefore, the measurement of the base surface data becomes unnecessary at the time of the image density adjustment control, and it becomes unnecessary to align the phases of base surface data and toner patch on the intermediate transfer belt. Accordingly, the time required for the image adjustment control can be reduced. As described above, according to Embodiment 1, the time required for the image adjustment can be reduced while maintaining the detection accuracy.

Embodiment 2

Embodiment 2 includes a unit for detecting the amount of positional deviation of the patch by the phase of the intermediate transfer belt 12 by using the reflection light sensor 50 and the patch for positional deviation detection. Embodiment 2 corrects the patch for misregistration adjustment by using the information of the belt phase difference Δp calculated in the belt phase difference detection control and using the amount of positional deviation. The same reference numerals are used for the components similar to those in Embodiment 1, and a description of such components is omitted. Embodiment 2 corrects the positional deviation resulting from the intermediate transfer belt 12, when the intermediate transfer belt 12 is not moving at a constant moving speed Vb due to various factors, and a toner patch is not formed at equal intervals on the intermediate transfer belt 12.

(Outline of Image Forming Apparatus)

In Embodiment 2, the measurement of the detection timing of a toner patch is performed by using the reflection light sensor 50 having the same configuration as that in FIG. 1B. Specifically, the timing at which the regular reflection light amount detected by the light receiving element 52*b* becomes less than a predetermined value is set at the timing at which the tip of a toner patch is detected. Thereafter, the timing at which the regular reflection light amount detected by the light receiving element 52*b* becomes equal to or more than the predetermined value is set at the timing at which the rear end of the toner patch is detected. In this manner, the timing detection of the toner patch is performed.

(Functional Block Diagram)

Figure 9:
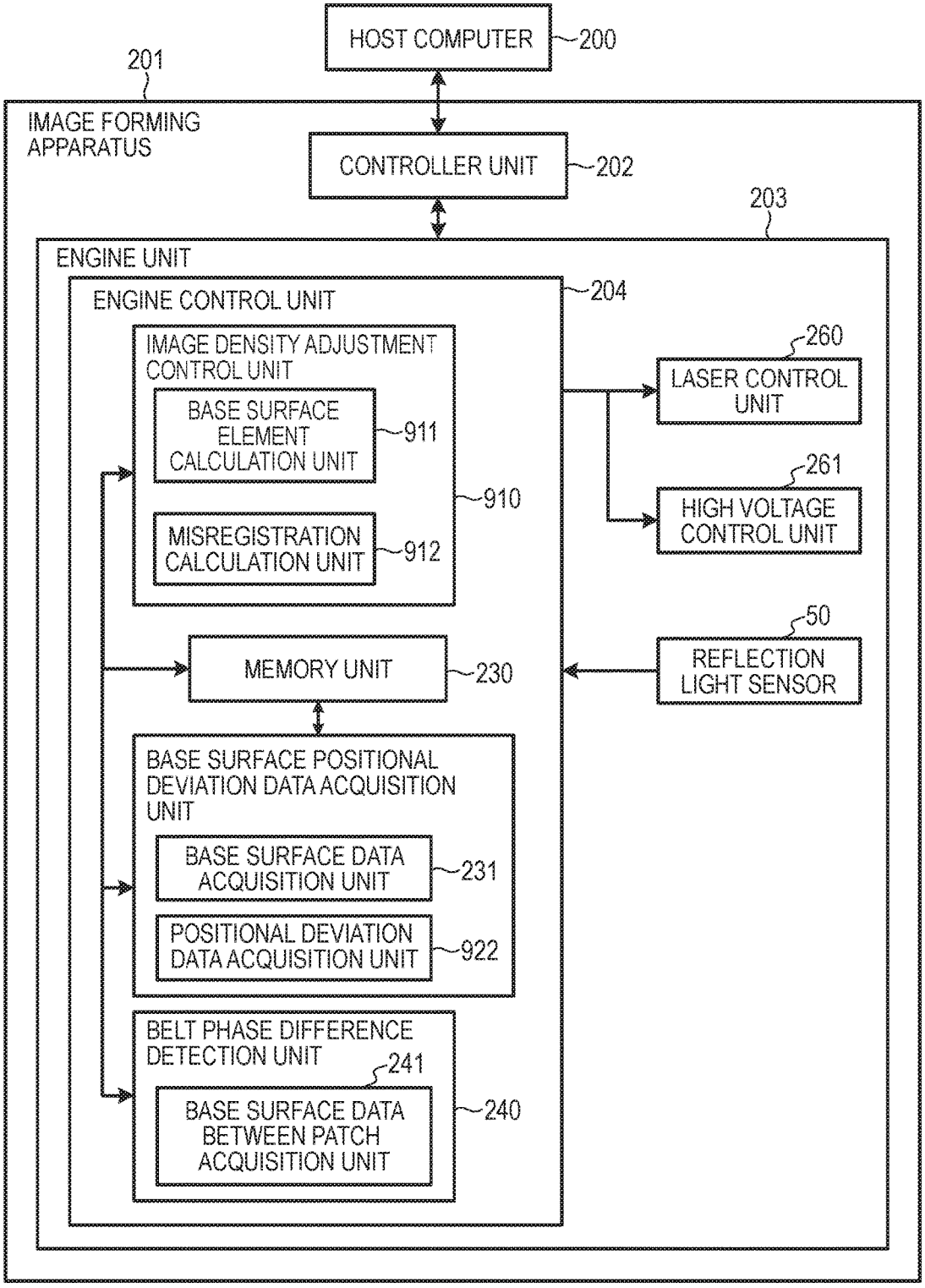
FIG. 9 is a functional block diagram of the image forming apparatus of Embodiment 2.

FIG. 9 is a functional block diagram of Embodiment 2. The image misregistration adjustment control unit 910 detects a toner patch 62 for misregistration adjustment (see FIG. 10A) formed on the intermediate transfer belt 12 by the reflection light sensor 50, and stores the result in the memory unit 230. The image misregistration adjustment control unit 910 calculates the relative misregistration amount between each station from the calculated results of the belt phase difference detection unit 240, a base surface element calculation unit 911, and a misregistration calculation unit 912, based on the data stored in the memory unit 230. The image misregistration adjustment control unit 910 feeds back the calculated misregistration amount to the laser control unit 260, and corrects the image formation timing. With the above control, the misregistration between each station is adjusted.

A base surface positional deviation data acquisition unit 920 stores, in the memory unit 230, the base surface data 1001 acquired by the base surface data acquisition unit 231 and positional deviation data 1004 acquired by a positional deviation data acquisition unit 922 in association with the phase of the intermediate transfer belt 12. The positional deviation data acquisition unit 922 calculates the positional deviation data for each station from the result of detecting, by the reflection light sensor 50, the toner patch 62 for positional deviation detection formed on the intermediate transfer belt 12, and stores the calculated positional deviation data in the memory unit 230. Since the other processing is the same as that in Embodiment 1, a description of the other processing is omitted.

(Positional Deviation Data Acquisition Unit)

Figure 10A:
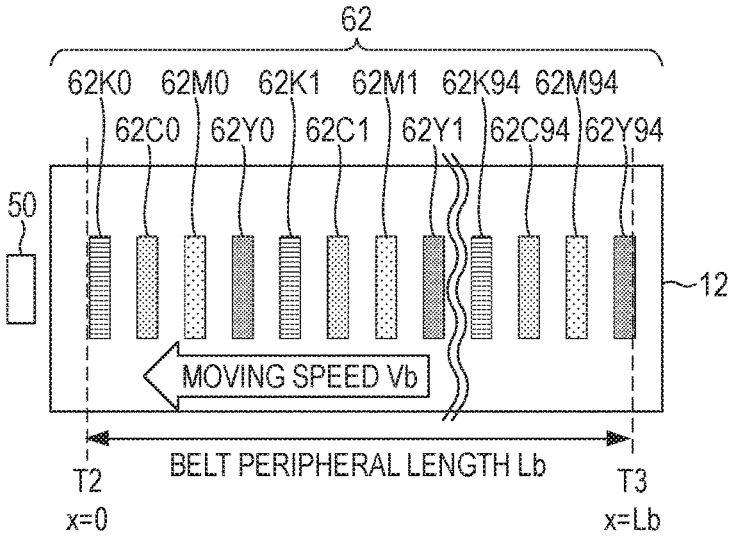
FIG. 10A, FIG. 10B and FIG. 10C are diagrams for describing positional deviation data acquisition control of Embodiment 2.
Figure 10B:
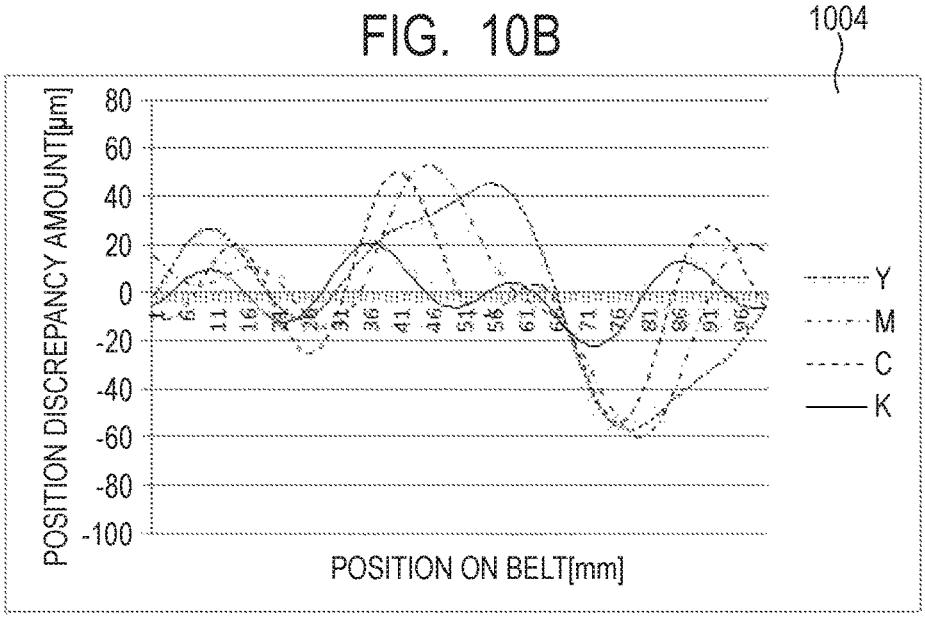
Figure 10C:
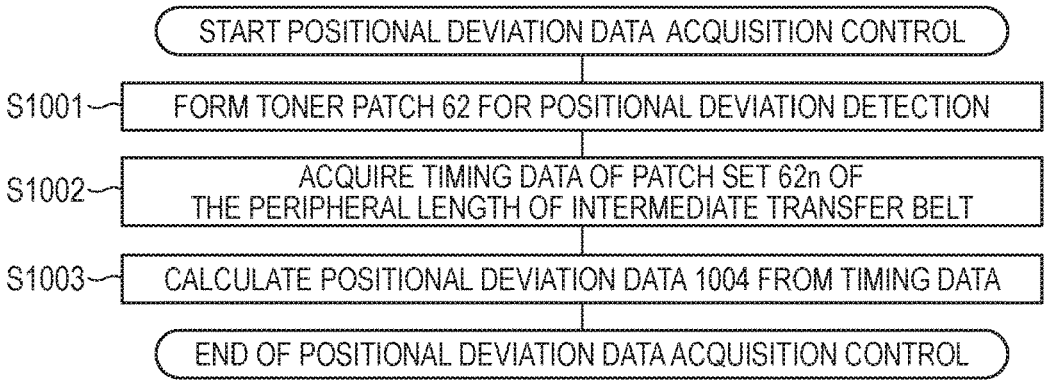

Referring to FIGS. 10A, 10B and 10C, the positional deviation data acquisition control performed by the positional deviation data acquisition unit 922 is described. FIG. 10A is a diagram illustrating an example of the toner patch 62 for positional deviation detection formed on the intermediate transfer belt 12. The intermediate transfer belt 12 is being conveyed at the moving speed Vb. The toner patch 62 for positional deviation detection includes the patch sets 62*n* repeatedly formed over the range of the peripheral length Lb of the intermediate transfer belt 12. Additionally, the patch set 62*n* includes patches 62Kn, 62Cn, 62Mn and 62Yn that are output from respective stations. In FIG. 10A, n is from 0 to 94. The positional deviation data acquisition unit 922 acquires the detection timing of the tip and rear end of each patch by the reflection light sensor 50. Thereafter, the positional deviation data acquisition unit 922 calculates the positional deviation data 1004 by the processing in the flow chart which will be described later, using the acquired detection timing. Further, it is assumed that the data of the detection timing at which the toner patch is detected is the elapsed time from the timing (T2) at which the tip of a toner patch 62K0 is detected to the time when the reflection light sensor 50 detects the first toner patch 62K0 at the timing ideal from a design perspective. The time from the timing T2 to the timing T3 corresponds to the time required for one rotation of the intermediate transfer belt 12 when the intermediate transfer belt 12 is moving at the moving speed Vb. Therefore, if the position corresponding to the timing T2 is set to x=0, the position corresponding to the timing T3 will be x=Lb. Further, the elapsed time may be the time from the timing of the center position of the toner patch 62K0. FIG. 10B is a graph of the acquired positional deviation data 1004, as a result of the positional deviation data acquisition unit 922 detecting the patch set 62*n* by the reflection light sensor 50. In FIG. 10B, the horizontal axis represents the position [mm] on the intermediate transfer belt 12, and the vertical axis represents the positional deviation amount [μm].

In Embodiment 2, it is assumed that the length of a patch in the conveying direction of the intermediate transfer belt 12 (hereinafter referred to as the patch length) of the patch set 62*n* is 1 [mm], the interval between adjacent patches is 1.5 [mm], and the interval between patches Δd of the same color is 10 [mm]. Additionally, the patch set 62*n* is the peripheral length Lb of the intermediate transfer belt 12, and is repeatedly formed in 950 [mm]. Thus, a total of 95 sets (n=0 to 94) of the patch set 62*n* are formed.

Next, referring to the flow chart of FIG. 10C, the flow of the positional deviation data acquisition control in Embodiment 2 is described. In S1001, the positional deviation data acquisition unit 922 forms the toner patch 62 for positional deviation detection on the intermediate transfer belt 12. In S1002, the positional deviation data acquisition unit 922 detects the timings of the tip and rear end of the patch set 62*n* for one rotation of the intermediate transfer belt 12 by the reflection light sensor 50. The data of the timings of the detected tip and rear end is hereafter referred to as the timing data. Here, the timings at which the tips of patch sets 62Yn, 62Mn, 62Cn and 62Kn are detected are set to tYns, tMns, tCns and tKns, respectively. Additionally, the timings at which the rear ends of the patch sets 62Yn, 62Mn, 62Cn and 62Kn are detected are set to tYne, tMne, tCne and tKne, respectively.

In S1003, the positional deviation data acquisition unit 922 calculates the positional deviation data 1004 from the timing data acquired in S1002. First, the center positions dYn, dMn, dCn and dKn of the patch sets 62Yn, 62Mn, 62Cn and 62Kn are calculated by Formulae (4-1) to (4-4) (n=0 to 94).

$$dKn=(tKns+(tKne-tKns)/2)\times Vb \quad \text{Formula (4-1)}$$

$$dCn=(tCns+(tCne-tCns)/2)\times Vb \quad \text{Formula (4-2)}$$

$$dMn=(tMns+(tMne-tMns)/2)\times Vb \quad \text{Formula (4-3)}$$

$$dYn=(tYns+(tYne-tYns)/2)\times Vb \quad \text{Formula (4-4)}$$

Next, the position discrepancies ΔdYn, ΔdMn, ΔdCn and ΔdKn of the center positions dYn, dMn, dCn, and dKn with respect to the ideal positions without a positional deviation are calculated by Formulae (5-1) to (5-4) (n=0 to 94). Further, the ideal position x is denoted by Δd×n+Δd×(0 to 4)/4.

$$\Delta dKn=dKn-(\Delta d\times n+\Delta d\times 0/4) \quad \text{Formula (5-1)}$$

$$\Delta dCn=dCn-(\Delta d\times n+\Delta d\times 1/4) \quad \text{Formula (5-2)}$$

$$\Delta dMn=dMn-(\Delta d\times n+\Delta d\times 2/4) \quad \text{Formula (5-3)}$$

$$\Delta dYn=dYn-(\Delta d\times n+\Delta d\times 3/4) \quad \text{Formula (5-4)}$$

The position discrepancies ΔdYn, ΔdMn, ΔdCn and ΔdKn thus acquired are taken as the positional deviation data 1004 (Bp(x)) in the ideal position x of the respective toner patches 60 (=Δd×n+Δd×(0 to 4)/4), respectively. The positional deviation data 1004 of the respective stations are stored in the memory unit 230 as Bp_y(x), Bp_m(x), Bp_c(x) and Bp_k(x). FIG. 10B illustrates examples of the measured positional deviation data 1004 of the respective stations. Further, the positional deviation data Bp(x) is discrete data at the intervals Δd. Thus, the positional deviation data at the position x on the intermediate transfer belt 12 where data does not exist is calculated by, for example, interpolation, by using the previous and subsequent positional deviation data.

(Base Surface Positional Deviation Data Acquisition Unit)

Figure 11A:
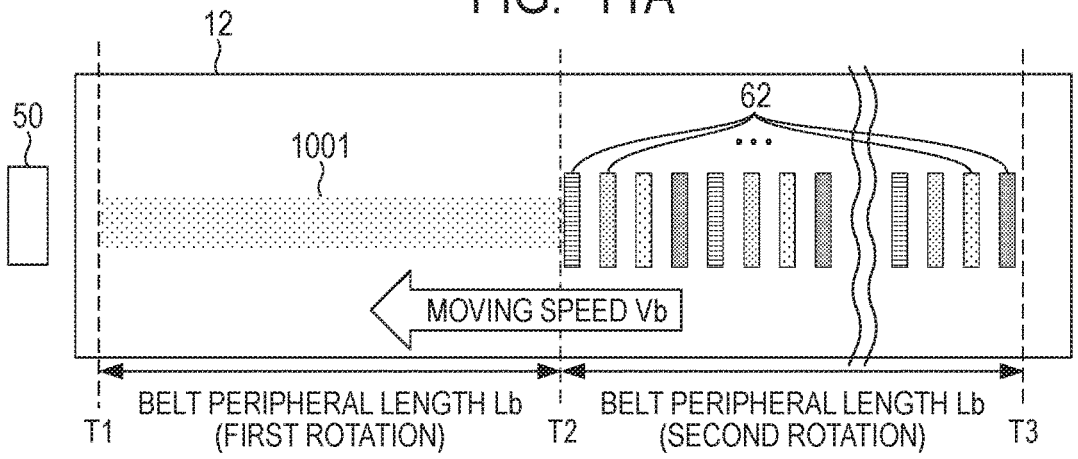
FIG. 11A and FIG. 11B are diagrams for describing base surface positional deviation data acquisition control of Embodiment 2.
Figure 11B:
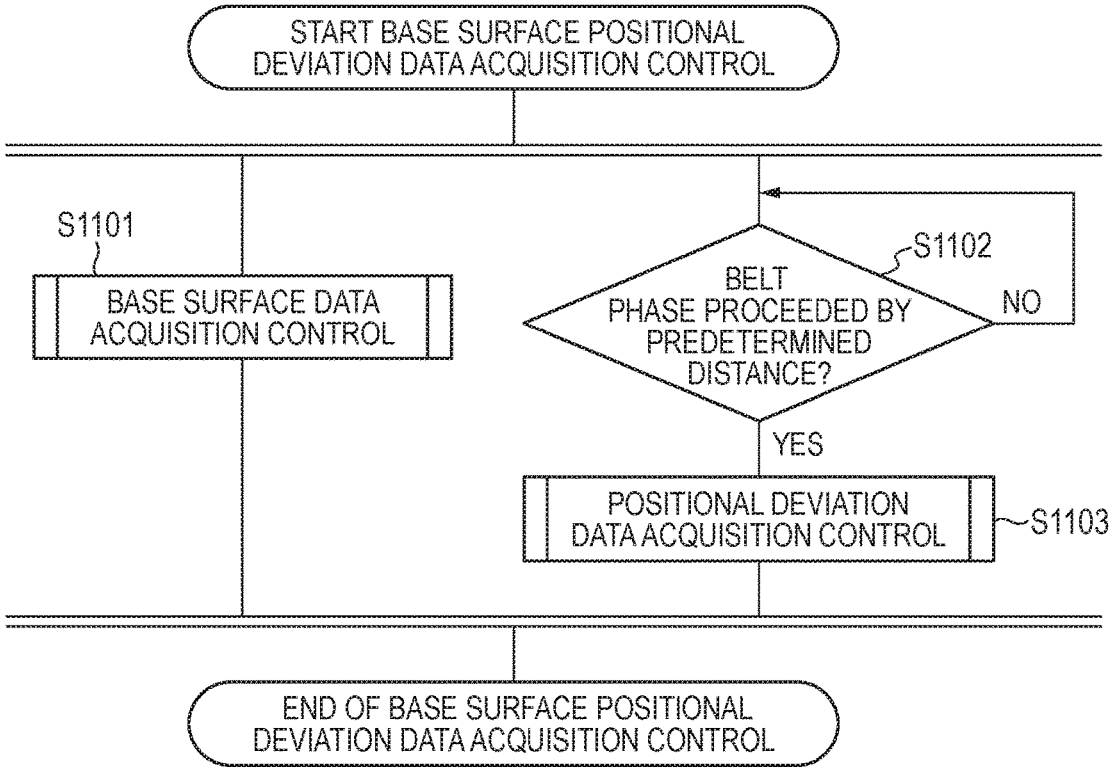

Referring to FIGS. 11A and 11B, the base surface positional deviation data acquisition control performed by the base surface positional deviation data acquisition unit 920 is described. The base surface positional deviation data acquisition control is performed at the timing at which the intermediate transfer belt 12 is newly mounted to the image forming apparatus, for example, at the timing of a mounting process of the intermediate transfer belt 12 in a factory, in a state where the surface of the intermediate transfer belt 12 is being conveyed at the moving speed Vb. The base surface positional deviation data acquisition control is performed between the timing T1, at which the base surface positional deviation data acquisition control was started, and the timing T2, at which the intermediate transfer belt 12 rotates for the belt peripheral length Lb (the first rotation), so as to acquire the base surface data 1001. Thereafter, the positional deviation data 1004 is acquired by performing the positional deviation data acquisition control between the timing T2 and the timing T3. At the timing T3, the intermediate transfer belt 12 finishes rotating for the belt peripheral length Lb for one more time (the second rotation). The positional deviation data acquisition control has been described with reference to FIG. 10C. The intermediate transfer belt 12 is driven to achieve the moving speed Vb. However, since there is a variation in individual intermediate transfer belts, the moving speed Vb is changed, assuming that the belt peripheral length Vb forms one cycle. The positional deviation data 1004 is the data of the positional deviation of the toner patch 62 resulting from, for example, a change in the moving speed Vb.

FIG. 11A illustrates the relationship between the acquisition timing of the base surface data 1001 and the acquisition timing of the positional deviation data 1004. The belt phase at the timing T1 is substantially the same as the belt phase at the timing T2. Therefore, the base surface data B(i) and the positional deviation data Bp(x) acquired by the base surface positional deviation data acquisition control are data associated with each other by the position x on the intermediate transfer belt 12=phase i×ΔT×Vp.

Next, referring to the flow chart of FIG. 11B, the base surface positional deviation data acquisition control is described. In S1101, the base surface positional deviation data acquisition unit 920 starts the base surface data acquisition control, and stores the base surface data 1001 in the memory unit 230. Additionally, in parallel to the processing in S1101 that starts the base surface data acquisition, the processing in S1102 is started. In S1102, the positional deviation data acquisition unit 922 determines whether or not the phase i of the intermediate transfer belt 12 proceeds by a predetermined distance, i.e., the phase idist. Here, it is assumed that the phase idist is the value calculated by subtracting, from the phase number corresponding to the belt peripheral length Lb (=Lb/Vb/ΔT), the phase number corresponding to the time since the formation of the toner patch 62 for positional deviation detection is started until the first toner patch 62 reaches the opposed position of the reflection light sensor 50.

In S1102, when the positional deviation data acquisition unit 922 determines that the phase i has not proceeded by the phase idist, the processing returns to S1102. When the positional deviation data acquisition unit 922 determines that the phase i has proceeded by the phase idist, the processing proceeds to S1103. In S1103, the positional deviation data acquisition unit 922 starts the positional deviation data acquisition control described with reference to FIGS. 10A, 10B and 10C, and stores the positional deviation data 1004 in the memory unit 230. In this manner, by delaying the start timing of the positional deviation data acquisition control by the phase idist, it is possible to align the measurement end timing of the base surface data 1001 with the measurement start timing of the positional deviation data 1004, as illustrated in FIG. 11A.

Further, a configuration may be adopted that includes a plurality of reflection light sensors 50. For example, in the configuration in which the measurements of the base surface data and the positional deviation data can be performed in parallel, the base surface data acquisition control may combine the phases of the two data by performing the positional deviation data acquisition control in S1103 and the base surface data acquisition control in S1101 in parallel.

(Image Misregistration Adjustment Control Unit)

Figure 12:
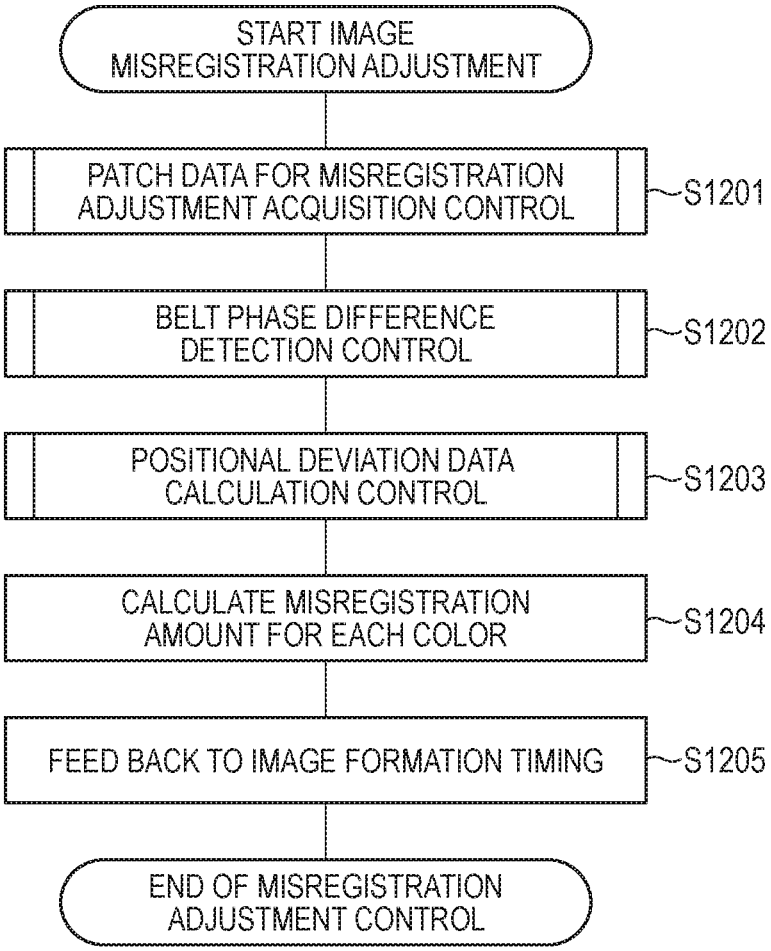
FIG. 12 is a flow chart showing the image misregistration adjustment control of Embodiment 2.

Next, referring to the flow chart of FIG. 12, the flow of the image misregistration adjustment control performed by the image misregistration adjustment control unit 910 in Embodiment 2 is described. In S1201, the image misregistration adjustment control unit 910 measures, by the patch data for misregistration adjustment acquisition control which will be described later, the toner patch for misregistration adjustment and the reflection light amount of the base surface between patches, and stores the toner patch and the reflection light amount in the memory unit 230 as the measurement data. In S1202, the image misregistration adjustment control unit 910 calculates the belt phase difference Δp of the intermediate transfer belt 12 by the belt phase difference detection control described with reference to FIG. 7B. In S1203, the image misregistration adjustment control unit 910 calculates the positional deviation data corresponding to the measurement data measured in S1201, by the positional deviation data calculation control which will be described later. In S1204, the image misregistration adjustment control unit 910 calculates the misregistration amount for each station from the measurement data, after correcting the timing by the positional deviation amount due to the same intermediate transfer belt 12. In other words, the image misregistration adjustment control unit 910 calculates the misregistration amount for each station, after correcting the positional deviation resulting from the intermediate transfer belt 12. In S1205, the image misregistration adjustment control unit 910 performs feedback to the image formation timing.

(Patch Data for Misregistration Adjustment Acquisition Control)

Figure 13A:
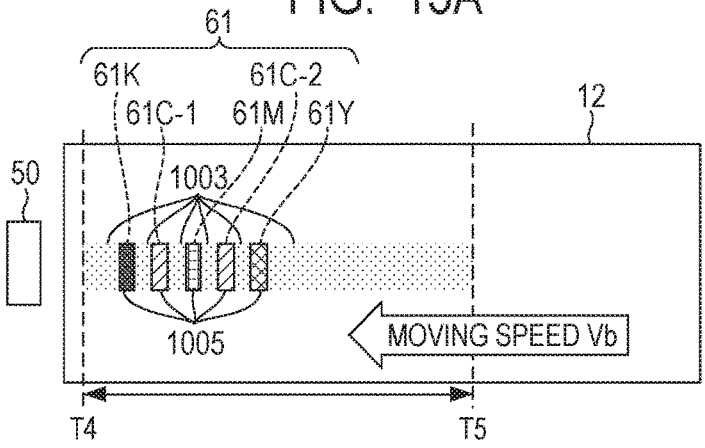
FIG. 13A and FIG. 13B are diagrams for describing the patch data for misregistration adjustment acquisition control of Embodiment 2.
Figure 13B:
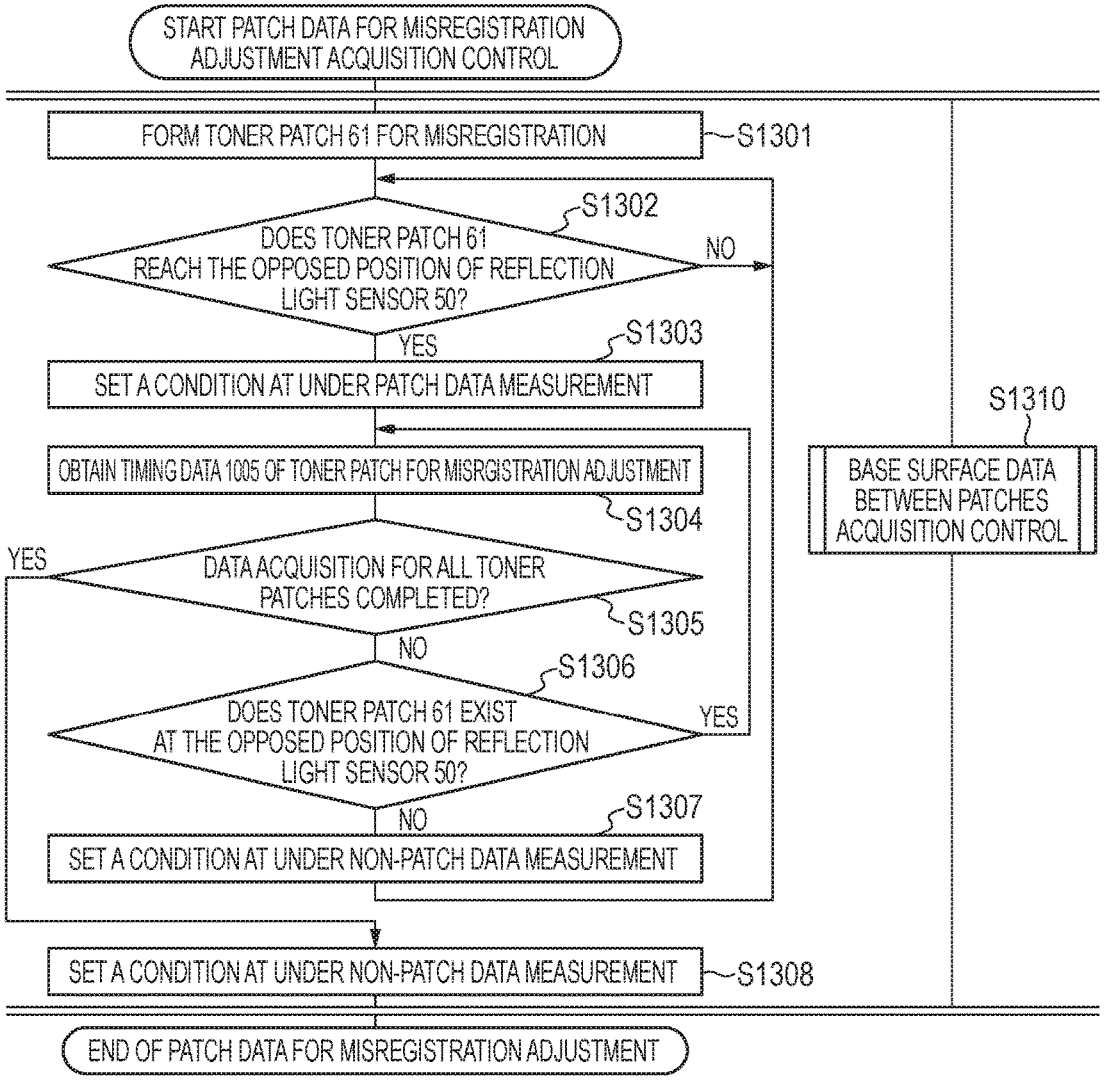

Referring to FIGS. 13A and 13B, the patch data for misregistration adjustment acquisition control in S1201 of FIG. 12, which is performed by the image misregistration adjustment control unit 910, is described. FIG. 13A is a diagram illustrating an example of the toner patch for misregistration adjustment formed on the intermediate transfer belt 12. For example, as in FIG. 10A, a toner patch 61 is formed such that the patch length is 1 mm, and the patch interval is 1.5 mm. The toner patch 61 includes patches 61K, 61C_1, 61C_2, 61M and 61Y that are output from the respective stations, and the interval is provided between the respective toner patches 61 so that the patches do not overlap on each other. Further, the number and kinds of the toner patches are not limited to those illustrated in this Embodiment, and may be changed depending on the rotation cycle of the photosensitive drum 5, the time spent for performing the misregistration adjustment control, and the required accuracy, etc.

The reflection light sensor 50 acquires the timing data 1005 of the toner patch 61 for misregistration adjustment, which are the detection timings of the tip and rear end of each toner patch, and also acquires the base surface data between patches 1003 by the base surface data between patches acquisition control. Further, the timing T4 is the timing before the toner patch 61 formed on the intermediate transfer belt 12 reaches the reflection light sensor 50. A timing T5 is the timing at which the measurement of all toner patches 61 for misregistration adjustments is completed, and the measurement of the base surface data between patches equal to or more than the predetermined number N is completed. It is assumed that the timing data 1005 of the toner patch 61 for misregistration adjustment is the elapsed time from the timing T4 of the measurement start.

Referring to the flow chart of FIG. 13B, the flow of the patch data for misregistration adjustment acquisition control in Embodiment 2 is described. In S1301, the image misregistration adjustment control unit 910 forms the predetermined toner patch 61 for misregistration adjustment on the intermediate transfer belt 12 conveyed at the moving speed Vb. In S1302, the image misregistration adjustment control unit 910 determines whether or not the toner patch 61 reaches the opposed position of the reflection light sensor 50. The image misregistration adjustment control unit 910 performs the determination as follows, for example. Whether or not the toner patch 61 reached the reflection light sensor 50 is determined based on the timing information delayed by the time required for the toner patch 61 to reach the reflection light sensor 50 from the timing information in which the toner patch 61 was formed in S1301.

In S1302, when the image misregistration adjustment control unit 910 determines that the toner patch 61 for misregistration adjustment does not reach the reflection light sensor 50, the processing returns to S1302. In S1302, when the image misregistration adjustment control unit 910 determines that the toner patch 61 for misregistration adjustment reaches the reflection light sensor 50, the processing proceeds to S1303. In S1303, the image misregistration adjustment control unit 910 sets the condition of the patch data for misregistration adjustment acquisition control at under patch data measurement.

In S1304, the image misregistration adjustment control unit 910 acquires the timing data 1005 of the toner patch 61 for misregistration adjustment, and stores the timing data 1005 in the memory unit 230. Here, timings dT61K, dT61C1, dT61M, dT61C2 and dT61Y, at which the centers of the respective toner patches 61 are detected, are calculated by calculating the average of the detection timings of the tip and rear end of the toner patch 61. The calculated timings dT61K, dT61C1, dT61M, dT61C2 and dT61Y are stored in the memory unit 230.

In S1305, the image misregistration adjustment control unit 910 determines whether or not the acquisition of the timing data for all toner patches 61 for misregistration adjustments formed in S1301 is completed. In S1305, when the image misregistration adjustment control unit 910 determines that the acquisition of the timing data for all toner patches 61 for misregistration adjustments is not completed, the processing proceeds to S1306. In S1306, the image misregistration adjustment control unit 910 determines whether or not the toner patch 61 exists at the opposed position of the reflection light sensor 50. Further, as for the determination method in S1306, the same method as that in S1302 described above is used.

In S1306, when the image misregistration adjustment control unit 910 determines that the toner patch 61 exists at the opposed position of the reflection light sensor 50, the processing returns to S1304, and the acquisition of the timing data of the toner patch 61 is continued. In S1306, when the image misregistration adjustment control unit 910 determines that the toner patch 61 does not exist at the opposed position of the reflection light sensor 50, the processing proceeds to S1307. In S1307, the image misregistration adjustment control unit 910 changes the condition of the patch data for misregistration adjustment acquisition control, whose condition is set in S1303, from under patch data measurement to under non-patch data measurement, and the processing returns to S1302.

In S1305, when the image misregistration adjustment control unit 910 determines that the acquisition of all toner patches 61 for misregistration adjustments is completed, the processing proceeds to S1308. In S1308, the image misregistration adjustment control unit 910 changes the condition of the patch data for misregistration adjustment acquisition control, whose condition is set in S1303, from under patch data measurement to under non-patch data measurement.

Additionally, in S1310, the base surface data between patches acquisition unit 241 performs the aforementioned base surface data between patches acquisition control in parallel to the processing in S1301 to S1308. The base surface data between patches acquisition control performed here is the same as that described with reference to FIG. 6 in Embodiment 1, and acquires the base surface data between patches while taking synchronization using the information on whether it is under patch data measurement or not. The image misregistration adjustment control unit 910 waits until both of the acquisition of the timing data 1005 of the toner patch 61 and the acquisition of the base surface data between patches 1003 are completed, and ends the patch data for misregistration adjustment acquisition control.

(Base Surface Element Calculation Unit)

Next, the positional deviation data calculation control performed by the base surface element calculation unit 911 in S1203 of FIG. 12 is described. The base surface element in Embodiment 2 is the positional deviation amount resulting from a change in the moving speed Vb at each position (each phase) of the intermediate transfer belt 12. The base surface element calculation unit 911 calculates the positional deviation data Br(x) at a position substantially the same as the position x at which the timing data 1005 of the toner patch 62 for misregistration adjustment is acquired, by using the belt phase difference Δp of the intermediate transfer belt 12 calculated by the belt phase difference detection control. The positional deviation data Br(x) is calculated by using Formula (6).

$$Br(x)=Bp(x+\Delta x)/Vb \tag{6}$$

Here, the position difference Ax of the intermediate transfer belt 12 is the value obtained by changing the belt phase difference Δp to the distance information of a position on the intermediate transfer belt 12, and is calculated by $\Delta x=\Delta p\times\Delta T\times Vp$. The positional deviation data Bp (x+Δx) is treated as data repeated with the cycle of the belt peripheral length Lb, by using the same method as in Formula (1). The positional deviation data Bp(x) is appropriately chosen from Bp_y(x), Bp_m(x), Bp_c(x) and Bp_k(x) (the positional deviation data 1004), according to the color of a patch of the timing data 1005 of the toner patch 61 for misregistration adjustment. It is assumed that the position x on the intermediate transfer belt 12 of each toner patch 61 is calculated by multiplying the timing data 1005 by the moving speed Vb of the intermediate transfer belt 12.

In this way, the timing data 1005 of the toner patch 61 for misregistration adjustment is corrected with Br(x), which is obtained by converting the positional deviation data Bp (x+Δx) into time. In this manner, it is possible to obtain the timing data of the toner patch 61 for misregistration adjustment, after removing the influence of the positional deviation due to the phase of the intermediate transfer belt 12.

As described above, according to Embodiment 2, the positional deviation data associated with the phase of the intermediate transfer belt 12 is acquired when acquiring the base surface data in advance. In this manner, it is possible to calculate the positional deviation amount of the toner patch 61 for misregistration adjustment resulting from the phase of the intermediate transfer belt 12, at the time of the image misregistration adjustment control. Therefore, the misregistration element due to the phase can be removed by correcting the detection timing of the toner patch 61 for misregistration adjustment by the positional deviation data due to the phase of the intermediate transfer belt 12.

As described above, the image misregistration adjustment control unit 910 calculates the positional deviation data 1004 having the substantially same phase as the phase of the timing data 1005 of the toner patch 61 for the misregistration adjustment on the intermediate transfer belt 12, based on the phase difference p. The image misregistration adjustment control unit 910 performs image adjustment by using the calculated positional deviation data 1004 and the timing data 1005 of the toner patch 61 for misregistration adjustment.

In conventional misregistration amendment, the patch pattern for misregistration adjustment having a length corresponding to the peripheral length Lb of the intermediate transfer belt 12 was formed on the intermediate transfer belt 12. In addition, it was necessary to remove the misregistration element due to the phase of the intermediate transfer belt 12 by averaging the misregistration amounts detected at respective belt phases over the peripheral length Lb of the intermediate transfer belt 12. However, if the misregistration element due to the phase of the intermediate transfer belt 12 is removed by using Embodiment 2, it is possible to perform accurate misregistration correction even with the toner patch 61 for misregistration adjustment shorter than the peripheral length Lb of the intermediate transfer belt 12. Therefore, the time required for the image adjustment control can be reduced. As described above, according to Embodiment 2, it is possible to reduce the time required for the image adjustment while maintaining the detection accuracy.

Embodiment 3

Embodiment 3 is characterized by determining whether remeasurement of the base surface data 1001 is necessary by using the result of the matching performed in the belt phase difference detection control, and remeasuring the base surface data 1001. The same reference numerals are used for the components similar to those in Embodiment 1, and a description of such components is omitted.

(Functional Block Diagram)

Figure 14:
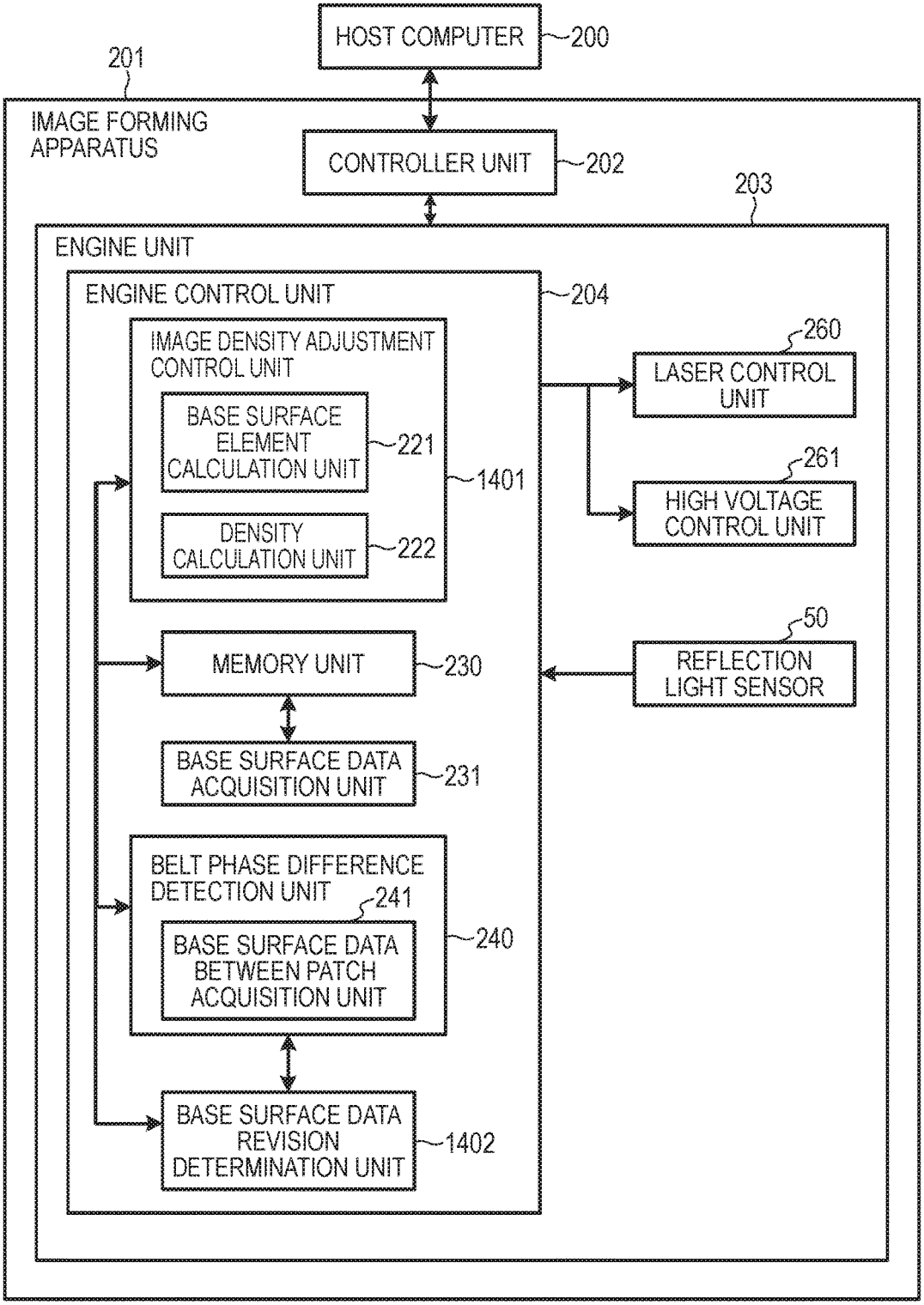
FIG. 14 is a functional block diagram of the image forming apparatus of Embodiment 3.

FIG. 14 is a functional block diagram of Embodiment 3. A base surface data revision determination unit 1402, which is a determination unit, determines whether or not remeasurement of the base surface data 1001 is necessary by using the matching result of the belt phase difference detection unit 240. An image density adjustment control unit 1401 stores the detection result of the reflection light sensor 50 in the memory unit 230. The image density adjustment control unit 1401 calculates the density of the toner patch 60 from the calculated results of the belt phase difference detection unit 240, the base surface data revision determination unit 1402, the base surface element calculation unit 221, and the density calculation unit 222, based on the detection result stored in the memory unit 230. The image density adjustment control unit 1401 feeds back the calculated result to the laser control unit 260 and the high voltage control unit 261, so as to reflect the calculated result to the process forming condition. With the above control, the maximum density and the halftone gradation characteristic of each color are adjusted.

When the base surface data revision determination unit 1402 determines that revision of the base surface data 1001 is necessary, the image density adjustment control unit 1401 performs the base surface data acquisition control by the base surface data acquisition unit 231. Since the functions other than the above are the same as those in Embodiment 1, a description of such functions is omitted.

(Base Surface Data Revision Determination Unit)

Figure 15:
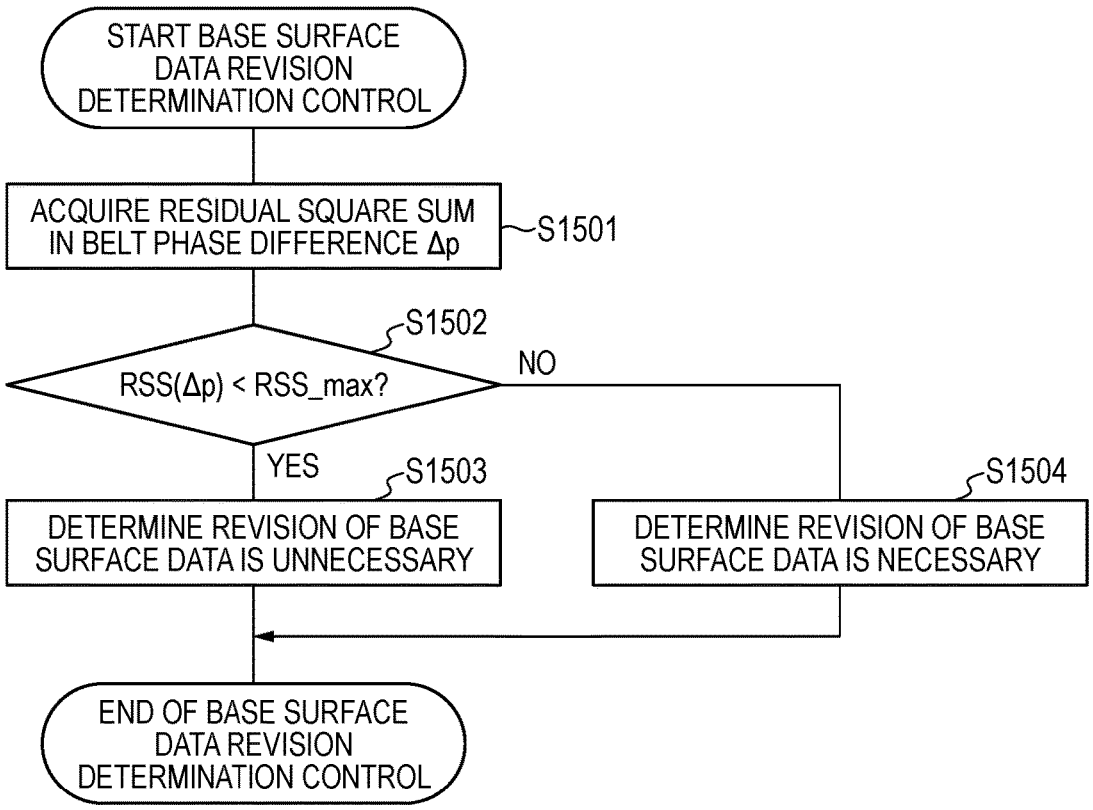
FIG. 15 is a flow chart showing the base surface data revision determination control of Embodiment 3.

Next, referring to the flow chart of FIG. 15, the base surface data revision determination control performed by the base surface data revision determination unit 1402 is described. In S1501, the base surface data revision determination unit 1402 acquires the residual square sum RSS (Δp) in the belt phase difference Δp from the belt phase difference detection unit 240. In S1502, the base surface data revision determination unit 1402 determines whether or not the value of the residual square sum RSS (Δp) is less than the maximum residual square sum RSS_max. In S1502, when the base surface data revision determination unit 1402 determines that the residual square sum RSS (Δp) is less than the maximum residual square sum RSS_max, the processing proceeds to S1503. In S1503, the base surface data revision determination unit 1402 determines that the revision of the base surface data 1001 is unnecessary, and the processing ends.

In S1502, when the base surface data revision determination unit 1402 determines that the residual square sum RSS (Δp) is equal to or more than maximum residual square sum RSS_max, the processing proceeds to S1504. In S1504, the base surface data revision determination unit 1402 determines that the revision of the base surface data 1001 is necessary, and the processing ends. When the reflection factor of the surface of the intermediate transfer belt 12 changes due to a variation with time, etc., from the time of acquiring the base surface data 1001, the value of the residual square sum RSS (Δp) in the belt phase difference Δp becomes large. The processing in S1502 is a determination process utilizing the fact that the value of the residual square sum RSS (Δp) becomes large due to a variation with time, etc. In Embodiment 3, the maximum residual square sum RSS_max is set to, for example, (the number of base surface data between patches N×the base surface data 1001 sample variance VAR)/2.

(Image Density Adjustment Control Unit)

Figure 16A:
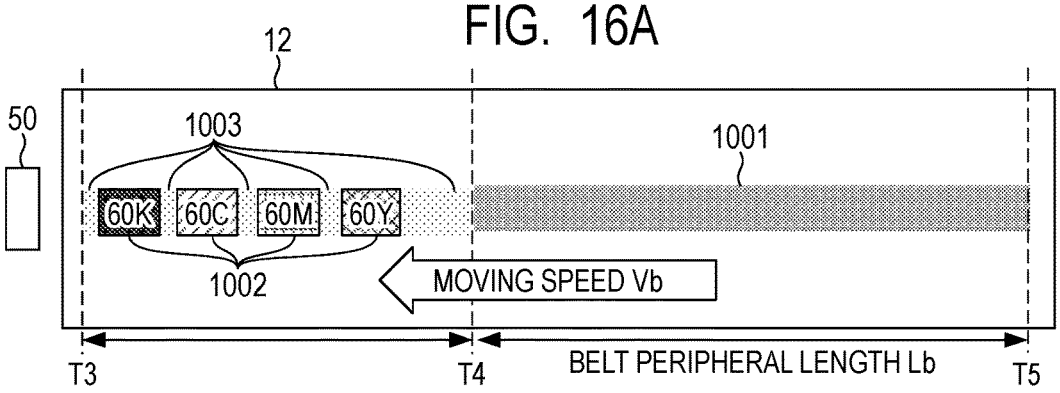
FIG. 16A and FIG. 16B are diagrams for describing image density adjustment control of Embodiment 3.
Figure 16B:
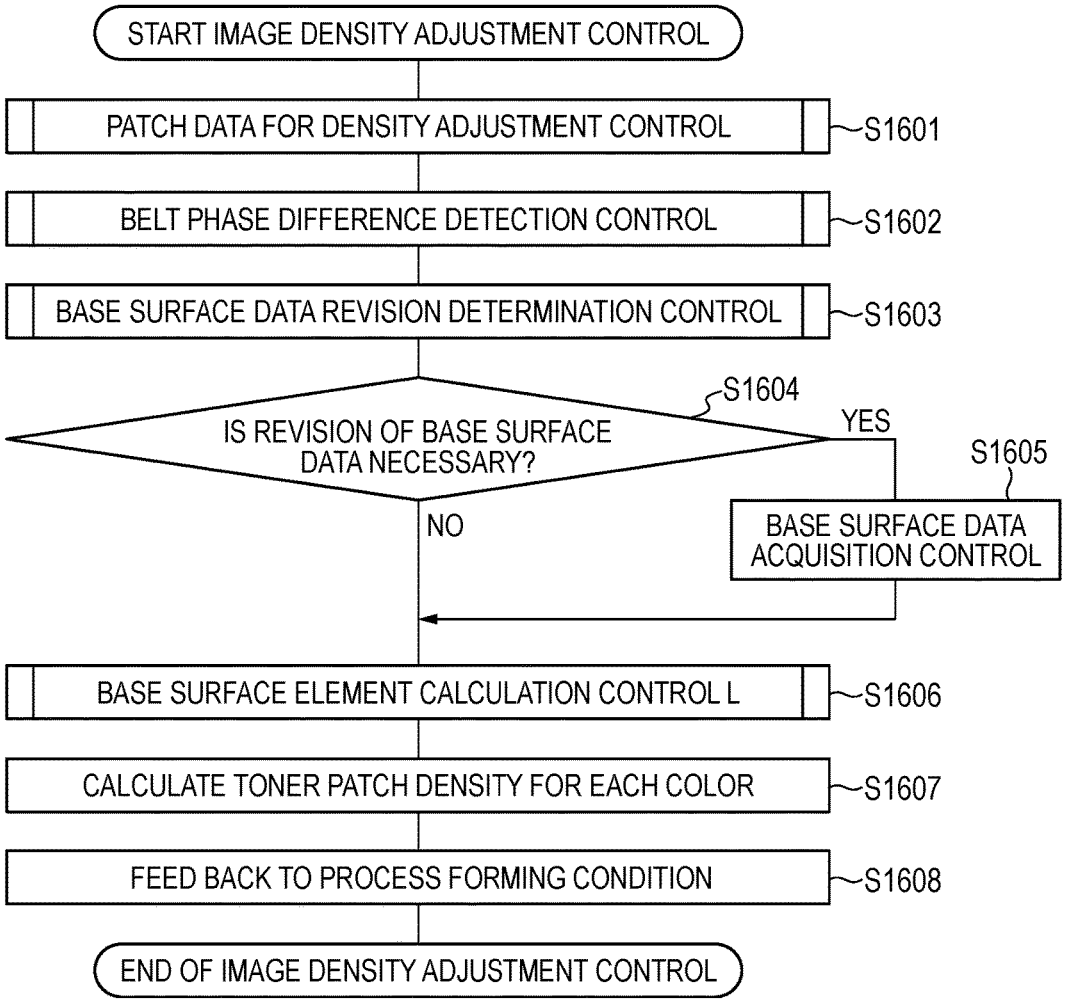

Next, referring to FIGS. 16A and 16B, the image density adjustment control performed by the image density adjustment control unit 1401 in Embodiment 3 is described. FIG. 16A is a diagram illustrating the acquisition timings of the toner patch 60 for density adjustment and the subsequent base surface data 1001 formed on the intermediate transfer belt 12, when the base surface data revision determination unit 1402 determines that the revision of the base surface data 1001 is necessary at the time of performing the image density adjustment control. At the timing T4 at which the acquisition of the base surface data between patches 1003 is completed, when the base surface data revision determination unit 1402 determines that the revision of the base surface is necessary, the next control is performed. That is, the base surface data 1001 is acquired in the range from the timing T4 to the timing T5 at which the time corresponding to the belt peripheral length Lb elapsed, and the base surface data 1001 in the memory unit 230 is revised. Further, when the base surface data revision determination unit 1402 determines that the revision of the base surface data 1001 is unnecessary (FIG. 15, S1503), only the base surface data between patches 1003 and the patch data 1002 for density adjustment are acquired as in FIG. 5A.

Next, referring to the flow chart of FIG. 16B, the flow of the image density adjustment control in Embodiment 3 is described. Further, since the processing in S1601 and S1602 is the same as the processing in S401 and S402 of FIG. 4, a description of the processing in S1601 and S1602 is omitted. In S1603, the image density adjustment control unit 1401 performs the base surface data revision determination control by the aforementioned base surface data revision determination unit 1402, and determines whether or not the revision of the base surface data 1001 is necessary.

In S1604, the image density adjustment control unit 1401 determines whether or not the revision of the base surface data 1001 is necessary. When the image density adjustment control unit 1401 determines that the revision of the base surface data 1001 is necessary, the processing proceeds to S1605. In S1605, the image density adjustment control unit 1401 stores new base surface data 1001 in the memory unit 230 by performing the aforementioned base surface data acquisition control (FIG. 3C), and the processing proceeds to S1606. In S1604, when the image density adjustment control unit 1401 determines that the revision of the base surface data 1001 is unnecessary, the processing proceeds to S1606. Since the processing in S1606 to S1608 is the same as the processing in S403 to S405 of FIG. 4, a description of the processing in S1606 to S1608 is omitted. Further, in the base surface element calculation control of S1606, the revised new base surface data 1001 is used.

As described above, according to Embodiment 3, even in the configuration in which the surface property of the intermediate transfer belt 12 changes due to a variation with time, etc., the base surface data 1001 can be revised as needed at the time of performing the image adjustment control. Additionally, the time spent for the image adjustment control can be reduced without spoiling the correction accuracy of the image adjustment control.

Further, in Embodiment 2, there is also a case where the thickness of the intermediate transfer belt 12 may be changed, and the characteristics of the speed variance of the intermediate transfer belt 12 may be changed. In such a case, in the image misregistration adjustment control in Embodiment 2, the base surface data revision determination control may be performed. In this case, the base surface positional deviation data acquisition control described with reference to FIGS. 11A and 11B may be performed between the processing of S1202 and the processing of S1203 of FIG. 12. As described above, according to Embodiment 3, the time required for the image adjustment can be reduced while maintaining the detection accuracy.

Further, in the Embodiments described above, the configuration has been described in which the image for adjustment is formed on the intermediate transfer belt bearing the toner image. However, the present invention may be applied to, for example, a configuration in which an image for adjustment is formed on a conveying belt (rotary member) bearing a recording material.

(Effect of the Invention)

According to the present invention, the time required for the image adjustment can be reduced while maintaining the detection accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-147438, filed Jul. 31, 2017, which is hereby incorporated by reference herein in its entirety.

What is claimed is:

1. An image forming apparatus comprising:

a rotary member configured to bear one of a toner image and a recording material, and to rotate;

an image forming unit configured to form the toner image on the rotary member;

a detection unit configured to detect a reflection light amount by emitting light to one of the rotary member and an image for adjustment formed on the rotary member, and receiving the light reflected from the one of the rotary member and the image for adjustment;

an image adjustment unit configured to perform, based on a detection result by the detection unit, image adjustment on the image for adjustment formed on the rotary member by the image forming unit;

a first acquisition unit configured to acquire first data in association with a position on the rotary member in a state where the image for adjustment is not formed, the first data corresponding to a detection result, by the detection unit, of an area on the rotary member at which the image for adjustment is not formed;

a second acquisition unit configured to acquire second data and third data in association with positions on the rotary member in a state where the image for adjustment is formed, the second data corresponding to a detection result by the detection unit, of an area on the rotary member at which the image for adjustment is formed, and the third data corresponding to a detection result, of an area on the rotary member at which the image for adjustment is not formed; and a comparison unit configured to compare the first data acquired by the first acquisition unit with the third data acquired by the second acquisition unit, wherein the image adjustment unit is configured to calculate the first data corresponding to the position of the second data on the rotary member, based on a comparison result obtained by the comparison unit, and performs the image adjustment by using the first data and the second data.

2. An image forming apparatus according to claim 1, wherein the comparison unit calculates a difference that is an amount shifted from the position associated with the first data so that the first data acquired by the first acquisition unit substantially corresponds the third data acquired by the second acquisition unit.

3. An image forming apparatus according to claim 2, wherein the image adjustment unit calculates the first data at a position substantially the same as the position of the second data on the rotary member, based on the difference calculated by the comparison unit, and performs the image adjustment by using the first data and the second data.

4. An image forming apparatus according to claim 2, wherein the comparison unit calculates a residual square sum of the first data and the third data by shifting the position of the first data over at least one rotation of the rotary member, and uses an amount shifted at the time when the residual square sum becomes the smallest as the difference.

5. An image forming apparatus according to claim 4, further comprising a determination unit that determines whether or not to revise the first data by acquiring new first data by the first acquisition unit based on the residual square sum in the difference detected by the comparison unit.

6. An image forming apparatus according to claim 2, wherein, when the position associated with the acquired third data is within a predetermined range from a tip or a rear end of the image for adjustment with respect to a rotation direction of the rotary member, the second acquisition unit removes the third data within the predetermined range from data for detecting the difference by the comparison unit.

7. An image forming apparatus according to claim 6, wherein the detection unit includes a light emitting part, and the measurement condition is an emitted light amount in the light emitting part.

8. An image forming apparatus according to claim 1, wherein the first acquisition unit detects the rotary member at predetermined time intervals using the detection unit in a state where the rotary member is being rotated at a predetermined moving speed, and acquires the first data for at least one round of the rotary member in advance.

9. An image forming apparatus according to claim 8, wherein the second acquisition unit continues to acquire the third data until the number of the third data acquired reaches a predetermined number, even after the second data is acquired.

10. An image forming apparatus according to claim 9, further comprising a memory unit that stores a first measurement condition at a time when the first data is acquired by the first acquisition unit, and a second measurement condition at a time when the third data is acquired by the second acquisition unit, wherein the image adjustment unit corrects the first data based on the first measurement condition and the second measurement condition.

11. An image forming apparatus according to claim 10, wherein the first data, the second data and the third data are reflection light amounts detected by the detection unit, and the image adjustment unit adjusts density of an image based on the reflection light amounts.

12. An image forming apparatus according to claim 11, wherein the image adjustment unit corrects a value related to the density indicated by the second data, based on the first data.

13. An image forming apparatus according to claim 10, wherein the first data, the second data and the third data are timing data based on the reflection light amount detected by the detection unit, and the image adjustment unit adjusts misregistration of an image based on the timing data.

14. An image forming apparatus according to claim 13, wherein the image adjustment unit corrects a value related to the position indicated by the second data, based on the first data.

15. An image forming apparatus according to claim 13, wherein the first acquisition unit forms, following acquisition of the first data, the image for adjustment for at least one round of the rotary member using the image forming unit, and acquires timing data of the image for adjustment detected by the detection unit in association with a position on the rotary member.

* * * * *